US011413506B2

(12) United States Patent
Bae et al.

(10) Patent No.: US 11,413,506 B2
(45) Date of Patent: Aug. 16, 2022

(54) HORIZONTALLY MOVABLE BOWLING BAG CAPABLE OF PREVENTING MOVEMENT OF BOWLING BALL

(71) Applicants: Sung Hwan Bae, Daegu (KR); Jae Young Bae, Daegu (KR); Si Hyeon Bae, Seoul (KR); Gang Nam Bae, Gyeonggi-do (KR)

(72) Inventors: Sung Hwan Bae, Daegu (KR); Jae Young Bae, Daegu (KR); Si Hyeon Bae, Seoul (KR); Gang Nam Bae, Gyeonggi-do (KR)

( * ) Notice: Subject to any disclaimer, the term of this patent is extended or adjusted under 35 U.S.C. 154(b) by 0 days.

(21) Appl. No.: 17/608,961

(22) PCT Filed: Jan. 22, 2021

(86) PCT No.: PCT/KR2021/000924

§ 371 (c)(1),
(2) Date: Nov. 4, 2021

(87) PCT Pub. No.: WO2021/150065

PCT Pub. Date: Jul. 29, 2021

(65) Prior Publication Data

US 2022/0203179 A1 Jun. 30, 2022

(30) Foreign Application Priority Data

Jan. 23, 2020 (KR) ..... 10-2020-0009133
Feb. 14, 2020 (KR) ..... 10-2020-0018126
Sep. 29, 2020 (KR) ..... 10-2020-0127530

(51) Int. Cl.
*A63B 47/00* (2006.01)
*A45C 13/02* (2006.01)

(52) U.S. Cl.
CPC ..... *A63B 47/007* (2013.01); *A45C 13/02* (2013.01); *A63B 2243/0054* (2013.01)

(58) Field of Classification Search
CPC . A45C 13/02; A63B 55/20; A63B 2243/0054; A63B 47/007; A63B 47/00
(Continued)

(56) References Cited

U.S. PATENT DOCUMENTS 2,617,012 A * 11/1952 Westley ..... A63B 47/007 473/59
2,872,029 A * 2/1959 Cart ..... A63B 47/007 206/579

(Continued)

FOREIGN PATENT DOCUMENTS

KR 2019950007880 4/1995
KR 1020020068856 8/2002
KR 1021385216 7/2020

*Primary Examiner* — Chun Hoi Cheung
(74) *Attorney, Agent, or Firm* — IPLA P.A.

(57) ABSTRACT

A horizontally movable bowling bag is provided to prevent movement of a bowling ball configured such that, in order to prevent movement or falling of the bowling ball when a frame is horizontally moved or when a cover is opened, four or more points of the bowling ball including a lower part of the bowling ball and a bottom surface of the bowling ball along an outer circumference thereof are adjacent to or supported by an upper part of a ball cup provided at the frame and an inner surface of the frame, whereby movement of the bowling ball in the frame is prevented when the frame is horizontally moved.

4 Claims, 24 Drawing Sheets

(58) Field of Classification Search
USPC ..... 206/315.91, 315.9; 190/18 A; 280/47.26
See application file for complete search history.

(56) References Cited

U.S. PATENT DOCUMENTS 2,922,453 A * 1/1960 Le Goff ..... A63B 47/007 206/315.91
3,281,883 A * 11/1966 Glantz ..... A63B 47/007 15/210.1
3,521,690 A * 7/1970 Davis ..... A63B 47/007 D3/319
3,554,257 A * 1/1971 Glantz ..... A63B 47/007 206/315.91
4,066,156 A * 1/1978 Basile ..... A45C 11/00 206/315.9
4,188,990 A * 2/1980 Ross ..... A63B 47/007 206/315.91
4,220,343 A * 9/1980 Robinson ..... B65D 11/10 220/252
4,311,223 A * 1/1982 Stein ..... A63B 47/007 206/315.9
5,074,571 A * 12/1991 Reese ..... B62B 1/14 D34/24
5,791,469 A * 8/1998 Be ..... A45C 5/14 206/315.91
6,099,023 A * 8/2000 Be ..... B62B 1/125 280/655
6,109,627 A * 8/2000 Be ..... B62B 1/26 190/18 A
6,193,120 B1 * 2/2001 Chang ..... A63B 57/20 206/315.9
6,722,671 B2 * 4/2004 Be ..... A63B 47/007 206/315.9
D512,564 S * 12/2005 Teitloff ..... D3/257
2008/0289982 A1 * 11/2008 Grant ..... A63B 47/007 206/315.9

* cited by examiner

HORIZONTALLY MOVABLE BOWLING BAG CAPABLE OF PREVENTING MOVEMENT OF BOWLING BALL

BACKGROUND

The present invention relates to a horizontally movable bowling bag capable of preventing movement of a bowling ball configured such that, in order to prevent movement or falling of the bowling ball when a frame is horizontally moved or when a cover is opened, four or more points of the bowling ball including a lower part of the bowling ball and a bottom surface of the bowling ball along an outer circumference thereof are adjacent to or supported by an upper part of a ball cup provided at the frame and an inner surface of the frame, whereby movement of the bowling ball in the frame is prevented when the frame is horizontally moved.

In general, most conventional bowling ball bags for bowling ball reception and transportation are configured to receive and carry only a single bowling ball. In some cases, wheels are mounted to the bottom surface of a bag, and a string connected to the bag is pulled to move the bag.

As described above, the conventional bowling ball bag is capable of receiving only a single bowling ball.

Consequently, in the case in which bowling balls having various different conditions corresponding to the characteristics of lanes are used and in the case in which a married couple, a pair of lovers, or a family carries their own bowling balls in order to enjoy bowling together, the same number of bowling ball bags as the number of bowling balls is inevitably needed to receive the bowling balls one by one. In order to carry several bowling ball bags, the bowling ball bags must be repeatedly carried to a specific position one by one, which is inconvenient. In addition, the number and volume of several bowling ball bags are increased, and therefore it is substantially difficult to carry the bowling ball bags.

In order to solve this problem, Korean Patent No. 313248 discloses technology related to a bowling ball bag, which is configured such that a wall 2 extending from a bottom case 1 from a rear surface of the bag to an upper edge 3 to which an upper cover case made of textile or artificial leather is connected is formed so as to have a height corresponding to the height of a bowling ball supported by a shell integrally formed in the bag and such that a hemispherical plate-shaped shell 5 is integrally formed in a reception compartment formed inside the bottom case 1, as shown in FIG. 1.

Support members 8 and 8' are integrally formed at opposite sides of the bottom of the reception compartment, covers 9 and 9', the surface of each of which is curved, are also installed on the support members 8 and 8', a support partition piece 33 is formed at the upper side of the reception compartment 32 of the bottom case 1", a cover 34' is installed at the support partition piece 33', and the bottom case 1 is moved through left and right wheels 19 in an inclined state.

In the above bowling bag, however, the wheels 19 are attached to only one side of the bottom case 1, whereby a main case, in which the bowling ball is loaded, is moved in a state of being obliquely supported by a handle. During transportation, therefore, the bowling bag is moved in the state in which the bowing bag supports the weight of the bowling ball, whereby it is difficult to carry the bowling bag.

In order to solve this problem, on the other hand, technology capable of moving a bag in a horizontal state is suggested by a bag bottom plate disclosed in Korean Patent Application Publication No. 2002-68856, wherein wheel support members 20 are disposed at a lower surface of a main body 1*a* so as to extend forwards, and rotary wheels 4*c* configured to be rotatable 360 degrees are mounted at opposite sides thereof such that the main body 1*a* can be freely moved, as shown in FIG. 2.

An outer portion of a telescopic handle 3 is fixedly installed at the inner surface of the main body 1*a* such that the main body is moved in a horizontal direction through the telescopic handle.

In the bag bottom plate, however, there is no separate construction capable of supporting a bowling ball when the bowling ball is received in the main body in the state in which the rotary wheels 4*c* are located inside the bottom portion of the main body 1*a*. When the main body is moved in the state in which the bowling ball is received in the main body, therefore, the main body easily falls due to movement of the center of gravity of a heavy object caused by movement of the bowing ball.

In addition, when the main body 1*a* is stopped in a standing-up state to withdraw the bowling ball therefrom, a ball cup inside the main body is provided with no separate support portion for supporting the bowling ball, whereby the bowling ball falls to one side, and therefore the bowling ball is damaged or a safety-related accident occurs.

SUMMARY OF THE INVENTION

The present invention has been made in view of the above problems, and it is an object of the present invention to provide a horizontally movable bowling bag capable of preventing movement of a bowling ball configured such that bowling balls can be easily carried in a loaded state so as to have a multilayered structure, such that the bowling balls are supported in a separated state, whereby damage to the bowling balls is prevented, such that a plurality of bowling balls, which are heavy, is moved in a horizontal direction, whereby transportation load is minimized, and such that rapid manufacture is possible while cost is reduced through integrated manufacture using a mold.

It is another object of the present invention to provide a horizontally movable bowling bag capable of preventing movement of a bowling ball configured such that a bowling ball is safely supported by a ball cup, whereby horizontal movement of the bag is easily performed, such that, when a cover is opened, movement of the bowling ball is prevented, whereby it is possible to prevent damage to the bowling ball and occurrence of a safety-related accident due to falling of the bowling ball, and such that a plurality of bowling balls is easily stored and carried while the bag is configured to have various different shapes.

In order to accomplish the above objects, the present invention provides a horizontally movable bowling bag capable of preventing movement of a bowling ball, the horizontally movable bowling bag including a frame having a space defined therein so as to receive two or more bowling balls in a state of being loaded in a vertical direction or a horizontal direction, the frame being provided at a bottom surface thereof with four or more rollers such that the frame is horizontally moved on a ground in the state in which the bowling balls are loaded therein, wherein at least one ball cup is provided in the inner space of the frame so as to support a plurality of bowling balls loaded in the frame in at least one of the vertical direction and the horizontal direction, the frame is made of a plastic material, has a space defined therein, and is provided with an opening formed so as to face at least one of a front and opposite sides thereof, a cover is connected to an outer surface of the frame or the opening by sewing, the cover being made of a textile sheet, generally forming a hexahedron when coupled to the frame, and being installed to open and close a portion thereof, the bowling ball located on an upper part of the ball cup in the frame is disposed in an adjacent state or in tight contact at four or more points, whereby movement of the bowling ball in the frame is prevented when the frame is horizontally moved, and a concave portion corresponding to the bowling ball is integrally formed in the ball cup such that the bowling ball is introduced into the space of the frame through the opening.

The cover connected to the frame by sewing may be provided at the inside thereof with an elastic support block configured to come into tight contact with one side surface of the bowling ball, and a support surface having a concave portion corresponding to the shape of the bowling ball may be integrally formed on at least one of the rear surface and opposite side surfaces of the frame inside the frame, excluding the elastic support block.

In order to prevent movement of the bowling ball when the frame is horizontally moved, a stopper may be provided, in a protruding state, on at least one of a position spaced apart from a contact point of the ball cup at which the bowling ball contacts the ball cup toward the opening and a position spaced apart from the contact point toward an inner surface thereof, whereby movement of the bowling ball may be prevented.

The ball cup may be provided in an upper part or a lower part thereof with a concave portion configured to support the bowling ball at the upper part or the lower part thereof, the stopper may be provided at one side of the ball cup, and the ball cup may be integrally formed with the frame when the frame is molded.

The ball cup may be separately manufactured so as to be assembled with a support portion integrally protruding from the frame by fitting and may then be coupled to the frame via a screw, the ball cup coupled to the frame may be formed so as to support an upper part or a lower part of the bowling ball, and the ball cup may be provided on one side thereof with a stopper.

The frame may be horizontally moved by a handle, and a pocket may be integrally provided at an outer surface of the frame or one side of the cover connected to the frame by sewing.

The stopper may have any one of: a configuration in which, in order to prevent movement of the bowling ball located at a contact point at which the bowling ball is supported as the center, the stopper is integrally installed at the ball cup or the support surface in a protruding state so as to support the bowling ball at each of opposite sides of the contact point;

a configuration in which an elastic member provided with a mounting protrusion while having a predetermined length so as to be supported by a mounting recess provided at the ball cup or the support surface is coupled to the stopper; and a configuration in which the stopper is integrally bonded to an upper side of the ball cup or the support surface so as to protrude upwards.

An incision portion may be formed around the stopper so as to face in the horizontal direction or the vertical direction such that the stopper has predetermined elasticity at a position of the ball cup or the support surface at which the stopper is formed.

The frame may be integrally provided at a side surface thereof with a concave connection recess inwardly depressed into a "["-shape such that the cover having a pocket is connected to the frame, and an auxiliary space configured to receive shoes or supplies may be installed at one of an upper part and a lower part of the inner surface of the frame so as to be separated from the space.

A reception chamber having a door configured to be opened to an outside of the frame may be further connected to an upper part of the frame, whereby shoes or supplies may be stored and withdrawn outside the frame.

A separately manufactured auxiliary frame may be integrally coupled to a lower part of the frame, the auxiliary frame may be provided at a bottom surface thereof with four or more rollers while receiving shoes or supplies therein, the frame and the auxiliary frame may be assembled with each other through a fixing protrusion and a fixing recess and a fixing piece and a fixing pin formed so as to correspond to each other, and the frame and the auxiliary frame may be simultaneously horizontally moved.

An auxiliary bag configured to receive a bowling ball therein may be loaded at an upper side of the frame in a stacked state.

The frame may be provided with openings facing opposite side surfaces thereof, and a separation plate configured to partition the opposite side openings may be integrally provided in the vertical direction or the horizontal direction, and the separation plate may also be provided with a support surface.

In the case in which the frame is provided with one opening that faces forwards, the frame may be deformed to load two bowling balls in the horizontal direction, to load two bowling balls in the vertical direction, to load three bowling balls in the vertical direction, to load four bowling balls in the vertical direction, to load five bowling balls in the vertical direction, or to load six bowling balls in the vertical direction, and in the case in which the frame is provided with two openings that face opposite sides of the frame, the frame may be deformed to load two bowling balls in the vertical direction, to load two bowling balls at the opposite sides thereof in the horizontal direction, to load four bowling balls in the vertical direction, or to load six bowling balls in the vertical direction.

The frame may be formed compactly so as to have an area defined in a width direction and a depth direction corresponding to an overall diameter of the bowling ball received therein in the width direction and the depth direction, and each roller may be freely rotatably connected to a support bracket protruding outwards from a lower part of the frame.

As is apparent from the above description, the present invention has effects in that bowling balls can be easily carried in a loaded state so as to have a multilayered structure, in that the bowling balls are supported in a separated state, whereby damage to the bowling balls is prevented, in that a plurality of bowling balls, which are heavy, is moved in a horizontal direction, whereby transportation load is minimized, and in that rapid manufacture is possible while cost is reduced through integrated manufacture using a mold.

In addition, the present invention has effects in that a bowling ball is safely supported by a ball cup, whereby horizontal movement of the bag is easily performed, in that, when a cover is opened, movement of the bowling ball is prevented, whereby it is possible to prevent damage to the bowling ball and occurrence of a safety-related accident due to falling of the bowling ball, and in that a plurality of bowling balls is easily stored and carried while the bag is configured to have various different shapes.

DETAILED DESCRIPTION OF THE INVENTION

Figure 1:
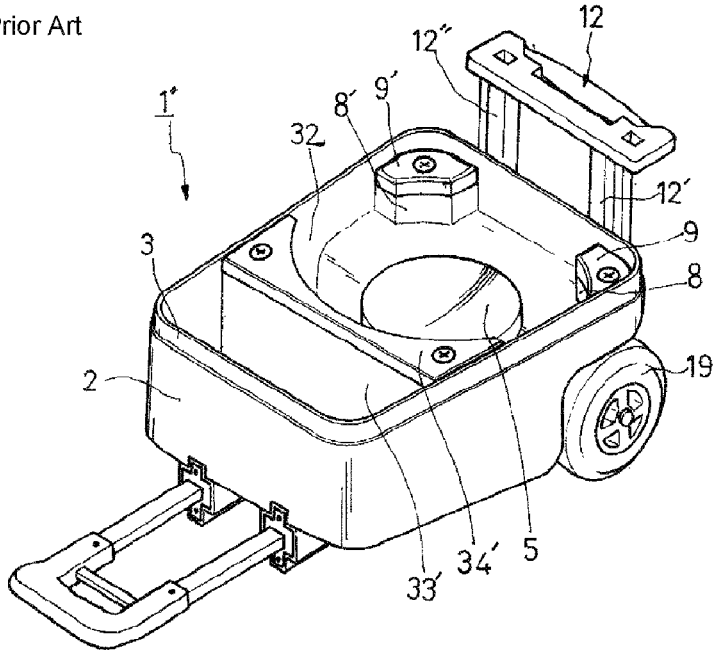
FIG. 1 Prior Art
FIGS. 1 and 2 are perspective views showing conventional bowling bags, respectively.
Figure 2:
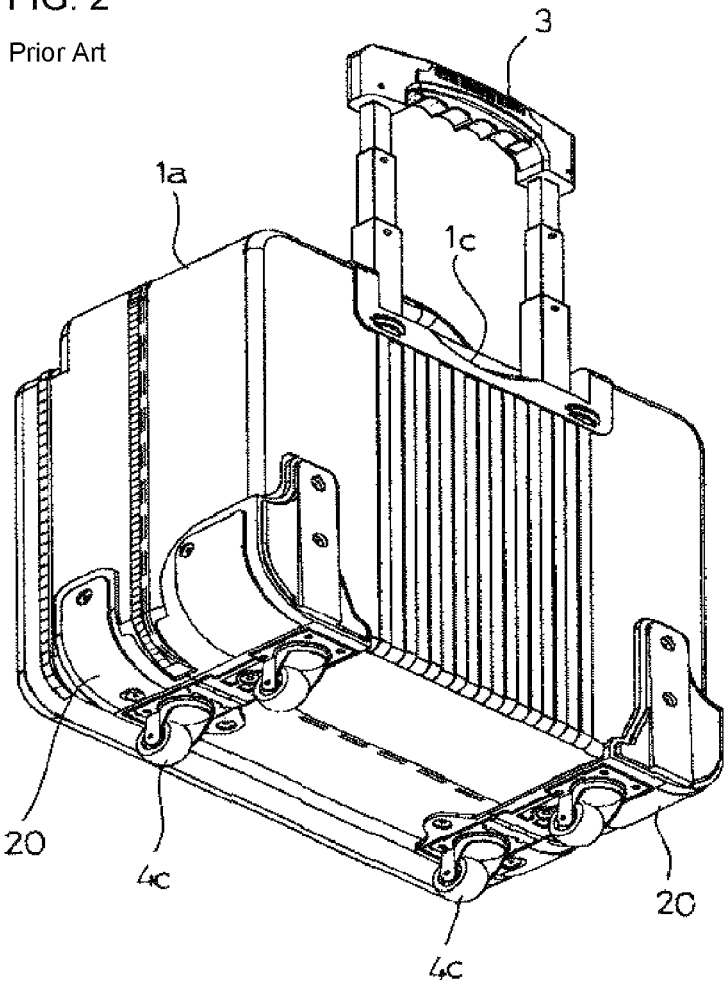
FIG. 2 Prior Art

Hereinafter, embodiments of the present invention will be described with reference to the accompanying drawings.

In a bowling bag B according to the present invention, three or more rollers 130 are installed at the bottom surface of a frame 100 configured to receive at least one bowling ball 300 therein such that the frame is horizontally movable on the ground.

In addition, the bowling bag B is installed so as to be easily movable inside a narrow reception space 900 through the rollers 130 installed at the bottom surface of the frame.

At this time, the frame 100 is configured such that an opening 160 is formed at one side of the frame so as to face at least one of the front surface and the opposite side surfaces of a hexahedron that is made of a plastic material and has a space 111 defined therein and such that a cover 180, which is made of a textile sheet, is connected along the edge of the frame by sewing so as to open and close the opening such that a separable space is formed by covering the opening.

Furthermore, a pocket 195 configured to be opened and closed by a zipper is further integrally provided outside the cover 180.

The frame 100 is further provided at the rear surface thereof with a handle 109 configured to be telescoped like an umbrella, and an auxiliary handle made of a textile sheet is also provided.

Figure 7:
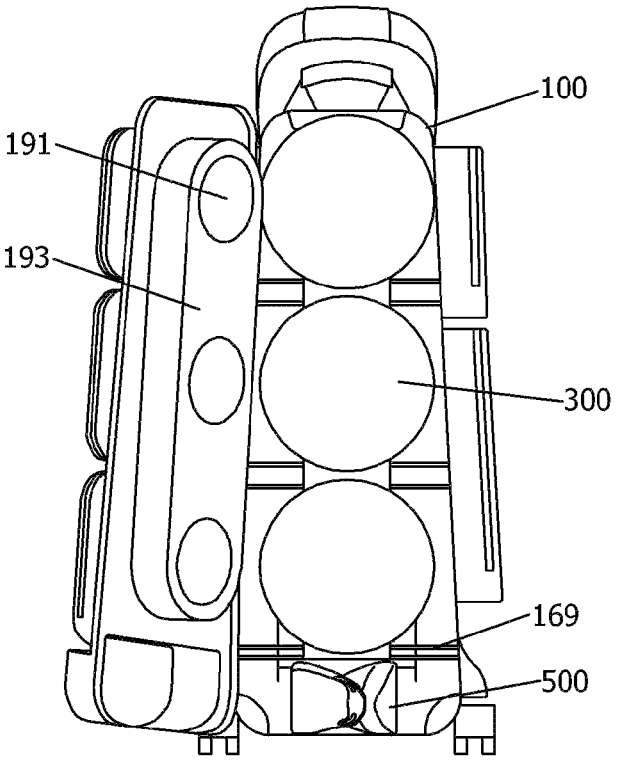
Figure 8:
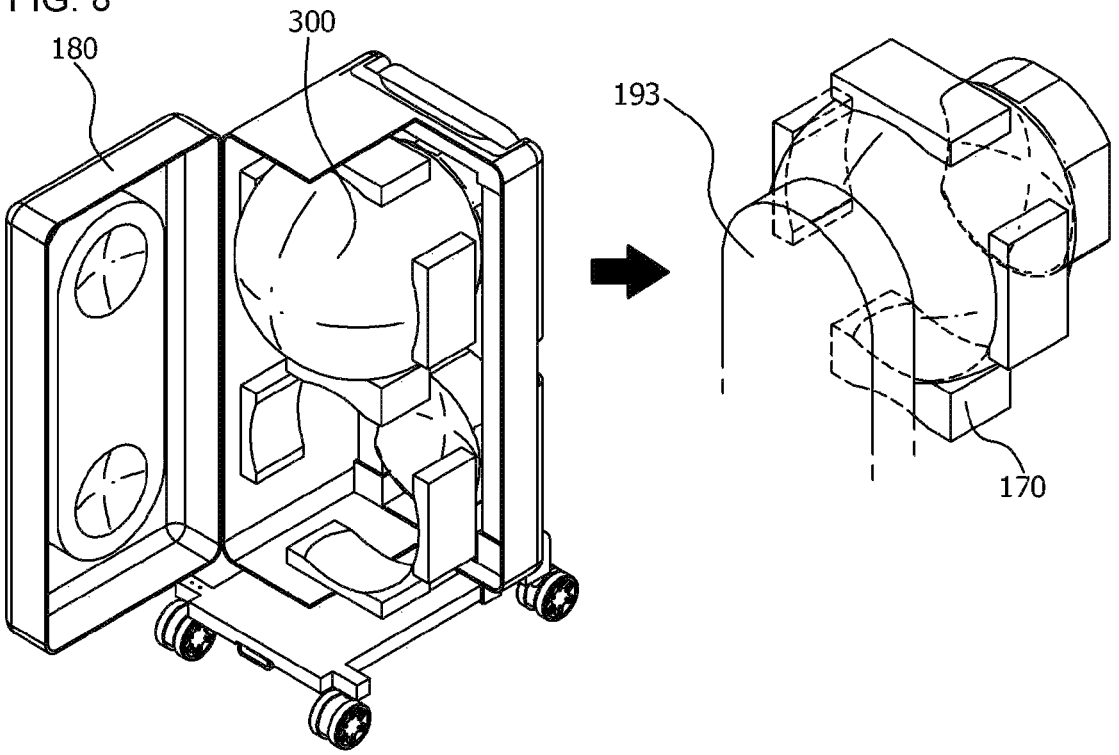
FIGS. 8 and 9 are a perspective view and a front view showing a tight contact state of a bowling ball according to the present invention, respectively.

Furthermore, as shown in FIGS. 7 and 8, when an elastic support block 193 having a concave recess 191 depressed to one side is provided at the cover 180, at least one ball cup 170 and a support surface 120 disposed adjacent to or in tight contact with at least three points including one point with which the elastic support block comes into tight contact, among five points of the rear surface, the left surface, the right surface, the upper surface, and the lower surface, along the outer diameter side of the bowling ball 300 in order to prevent movement of the bowling ball is provided at the inside of the frame 100 corresponding thereto.

At this time, the elastic support block 193 may be made of a soft plastic product or a sponge.

Also, in the present invention, as shown in FIG. 8, the circumference of the bowling ball 300 supported on the ball cups 170 is supported at four or more points through one elastic support block 193 provided inside the cover 180 and a plurality of support surfaces 120 disposed at the inner surface of the frame 100 along the circumference of the bowling ball such that movement of the bowling ball is prevented.

At this time, a concave portion corresponding to the shape of the bowling ball is integrally formed in each of the ball cups 170 and the support surfaces such that the bowling ball is easily introduced through the opening.

It is preferable for the ball cups 170 to be formed in left-right symmetry and in up-down symmetry. The ball cups 170 may be integrally formed at the frame by injection molding or may be separately injection-molded and then coupled to the frame.

Figure 35:
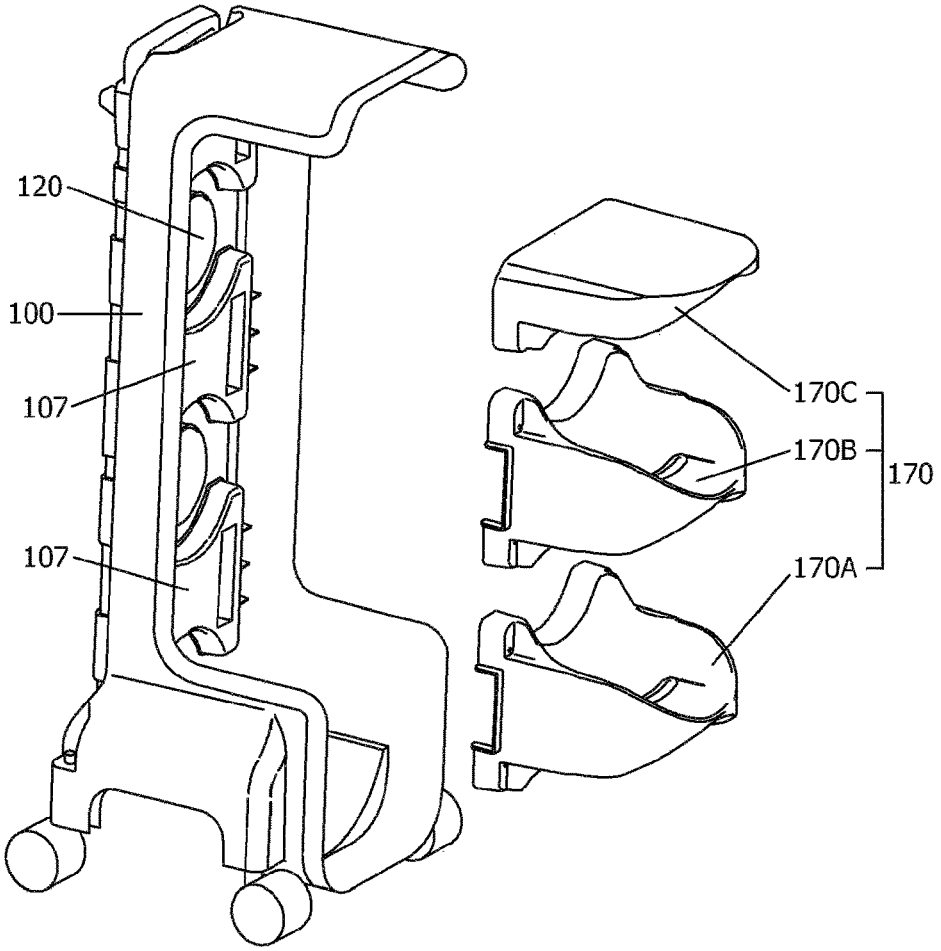
Figure 36:
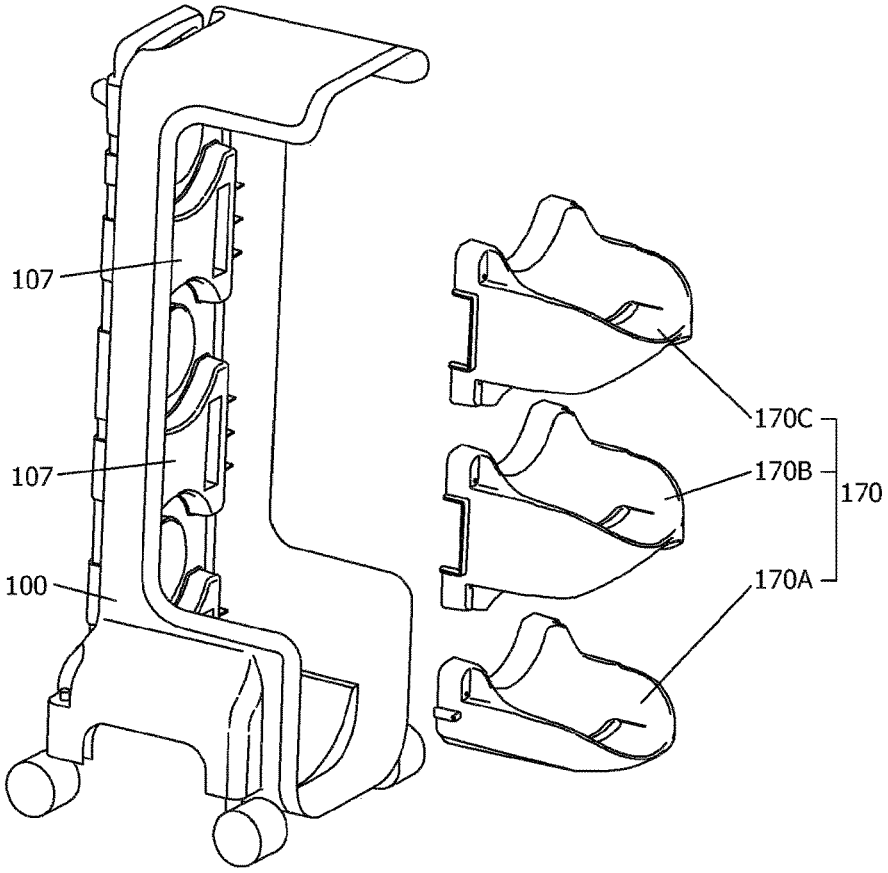
Figure 37:
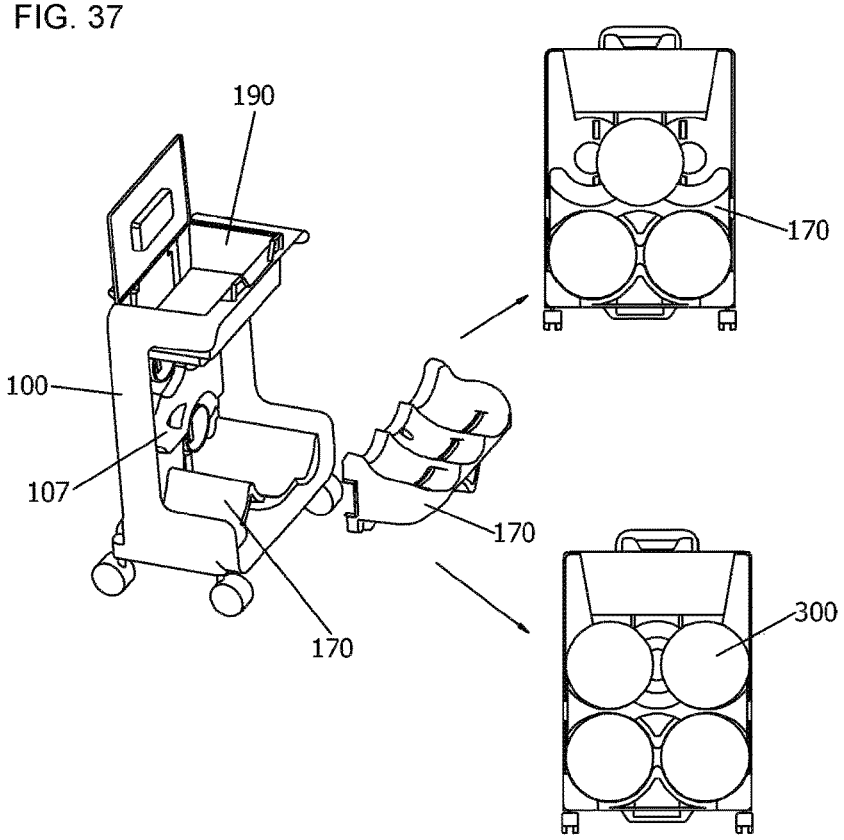
Figure 38:
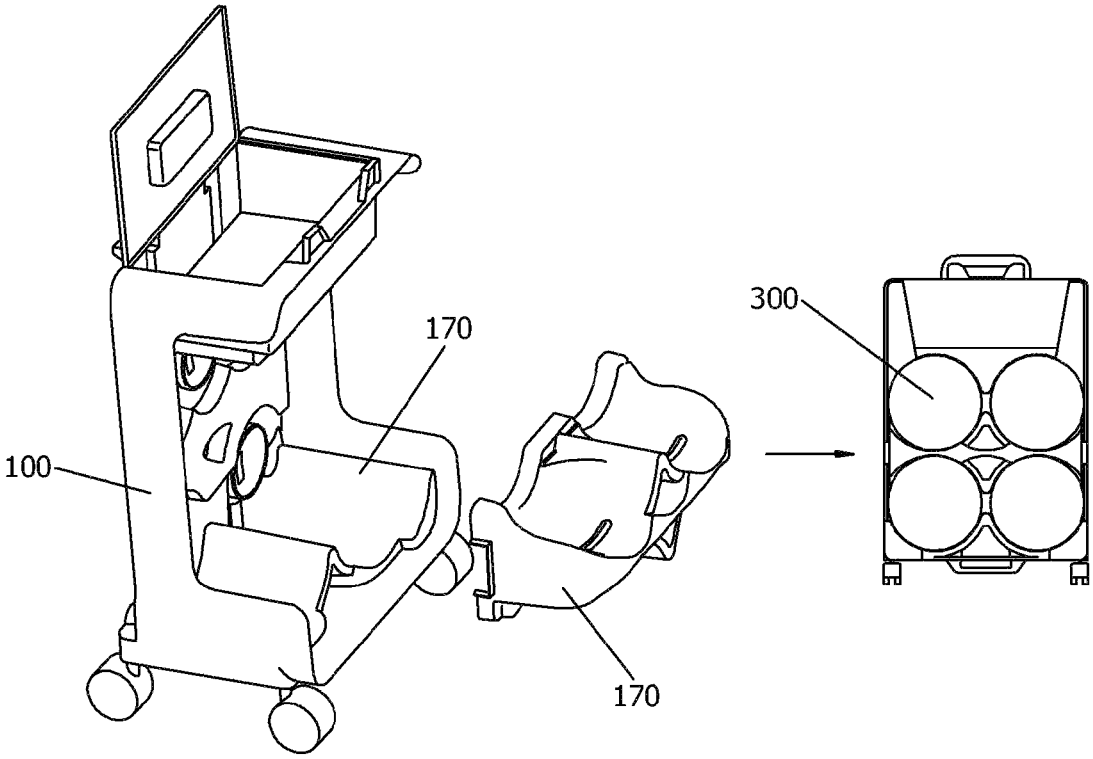
Figure 39:
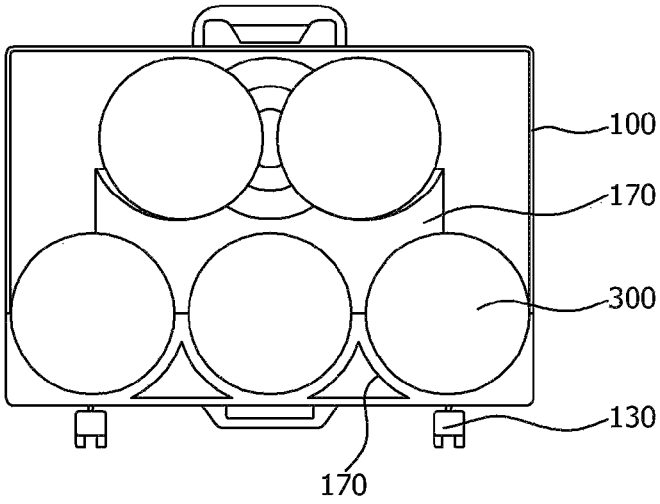
Figure 40:
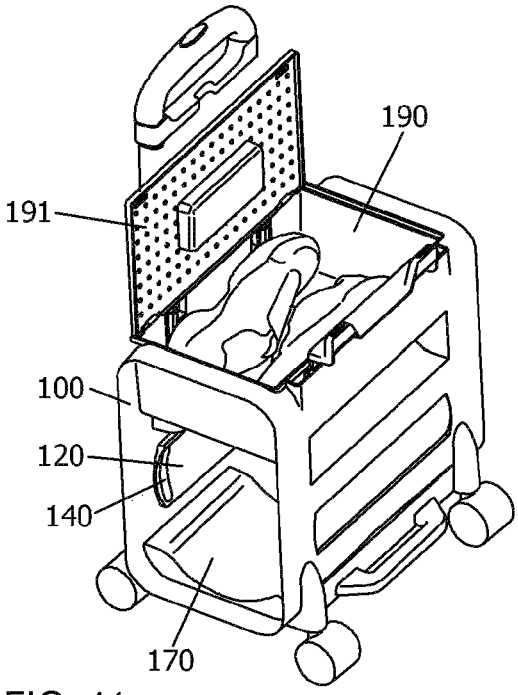
FIGS. 40 to 44 are use state views of bowling bags depending on the loading state of bowling balls received from the side according to embodiments of the present invention, respectively.
Figure 41:
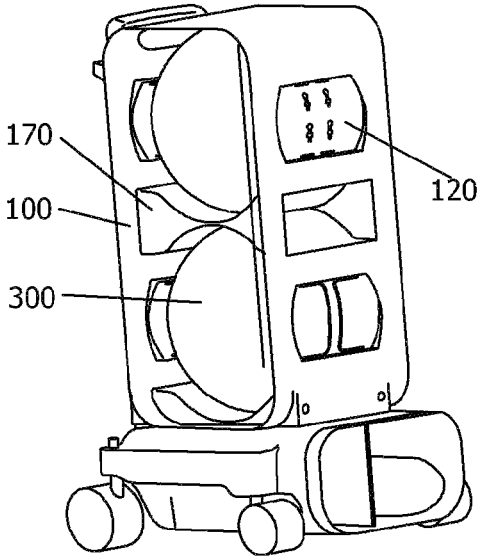
Figure 42:
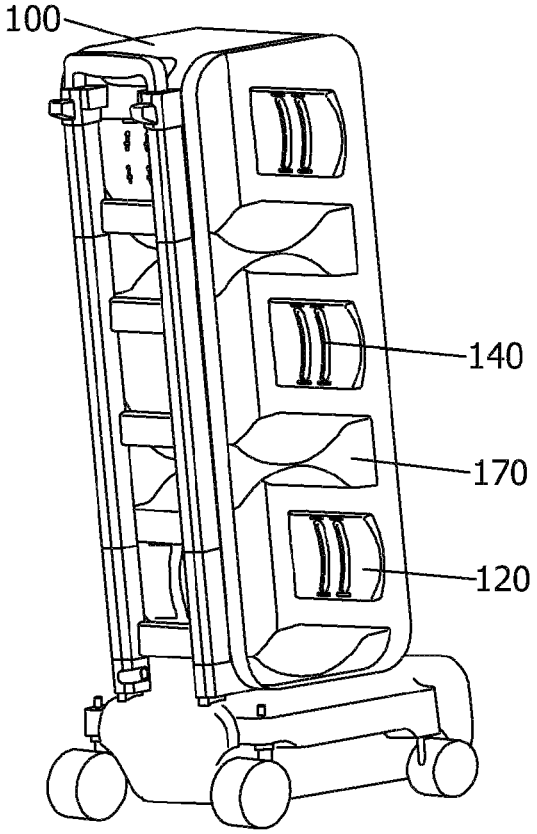
Figure 43:
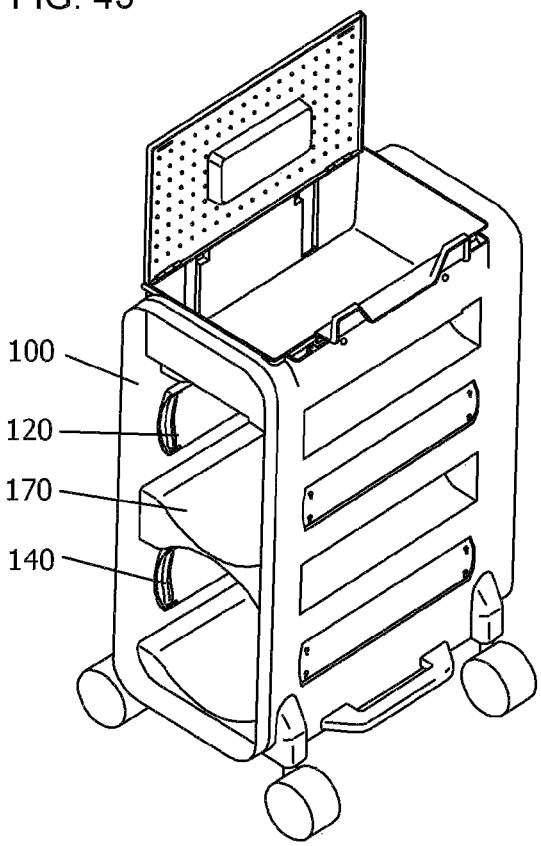
Figure 44:
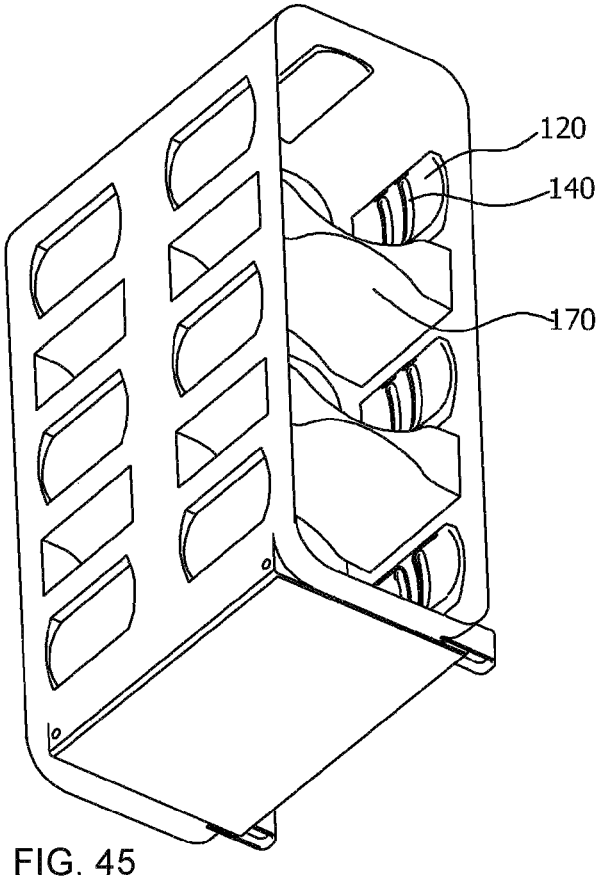
Figure 45:
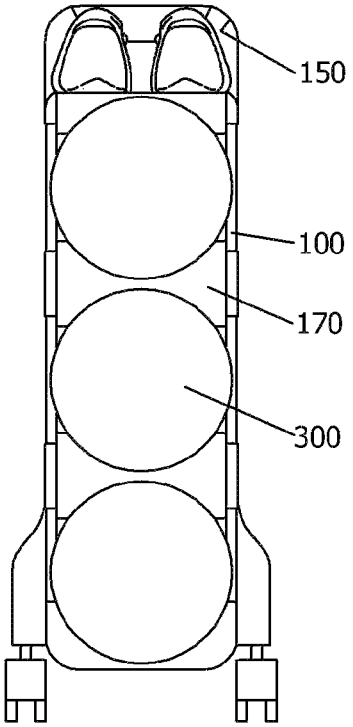
FIGS. 45 and 46 are installation state views of frames according to embodiments of the present invention, respectively.

In addition, when coupled by assembly as shown in FIG. 35, the ball cup 170 is coupled to a support portion 107 integrally protruding from the frame 100 via a screw (not shown) while being formed so as to be fitted on the support portion, and the support portion is formed in a protruding state so as to have a shape corresponding to the rear surface of the ball cup that is injection-molded such that the ball cup and the support portion are assembled with each other by fitting.

The ball cups 170 and the support surfaces 120 have arc-shaped concave portions such that the bottom and the side surface of the bowling ball 300 simultaneously come into surface contact therewith, and one surface of the bowling ball comes into contact with the inside of the frame that is horizontally moved by the rollers 130, whereby movement of the bowling ball is prevented.

Figure 30:
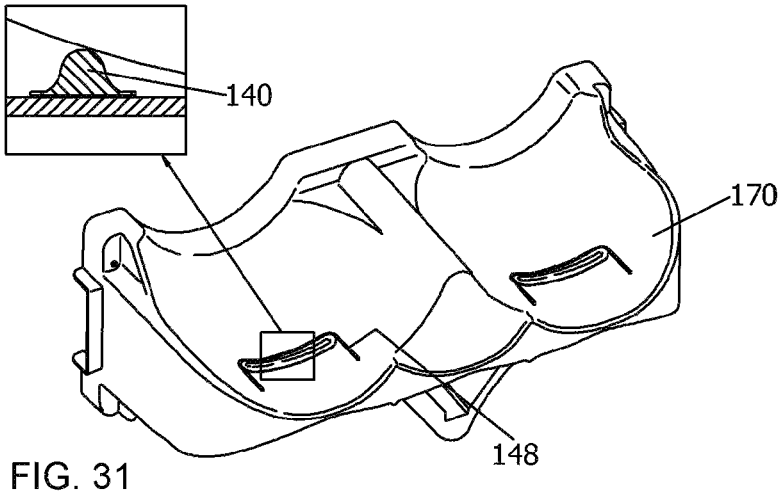

Furthermore, as shown in FIG. 30, a concave portion configured to support the upper part of the bowling ball may be formed in the bottom of the ball cup 170.

Figure 9:
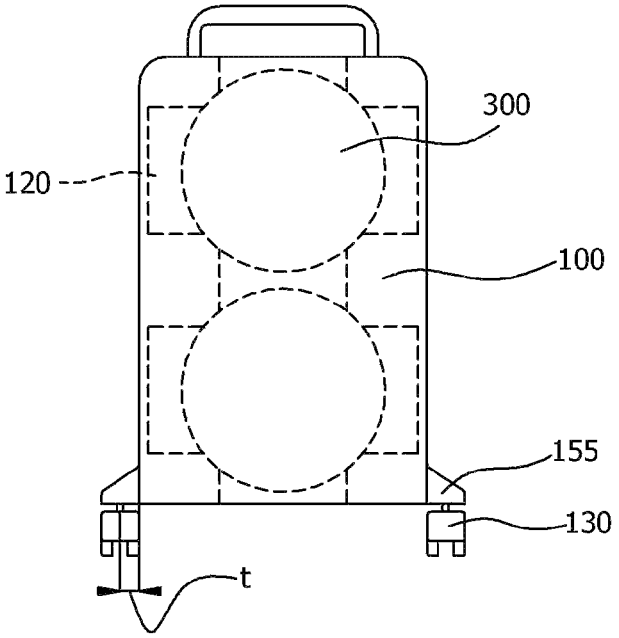

In addition, as shown in FIG. 9, when the roller 130 is freely rotatably connected to the center of a support bracket 155 having a central shaft connected to the outer surface of the frame 100 in a protruding state, the roller extends in a state of further protruding by a predetermined distance t than the side surface of the frame, whereby it is possible to realize a low-center-of-gravity design of the frame formed in a compact state so as to have substantially the same left and right width as the diameter of the bowling ball.

Furthermore, the roller is freely rotatably connected to the support bracket 155 that integrally protrudes only at opposite side bottoms thereof in at least one of a width direction and a depth direction of the frame.

Meanwhile, an auxiliary bag 600 configured to receive a bowling ball 300 or bowling shoes 500 therein may be stacked on the upper side of the frame 100.

Figure 10:
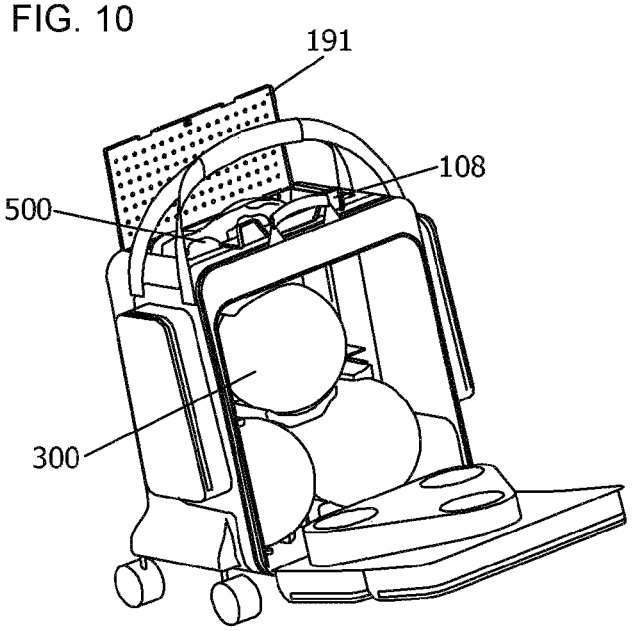
FIG. 10 is an assembly state view of a frame according to an embodiment of the present invention.
Figure 11:
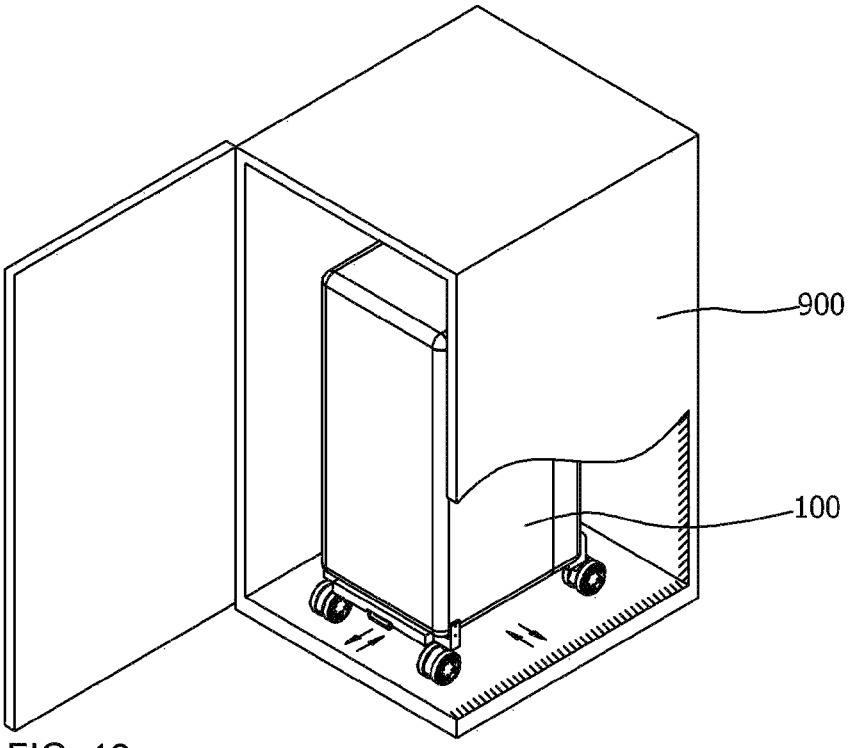
FIG. 11 is a reception state view of a bowling bag according to the present invention.

As shown in FIG. 10, the frame 100 may have a structure in which the frame 100 located above and an auxiliary frame 400 located below are connected to each other.

At this time, the auxiliary frame 400 is provided at the bottom surface with three or more rollers 130 while receiving shoes or supplies therein.

Furthermore, the frame and the auxiliary frame are assembled with each other through a fixing protrusion 411 and a fixing recess (not shown) and a fixing piece and a fixing pin 415 formed so as to correspond to each other.

At this time, the frame and the auxiliary frame are integrally coupled to each other so as to be simultaneously horizontally moved.

Figure 19:
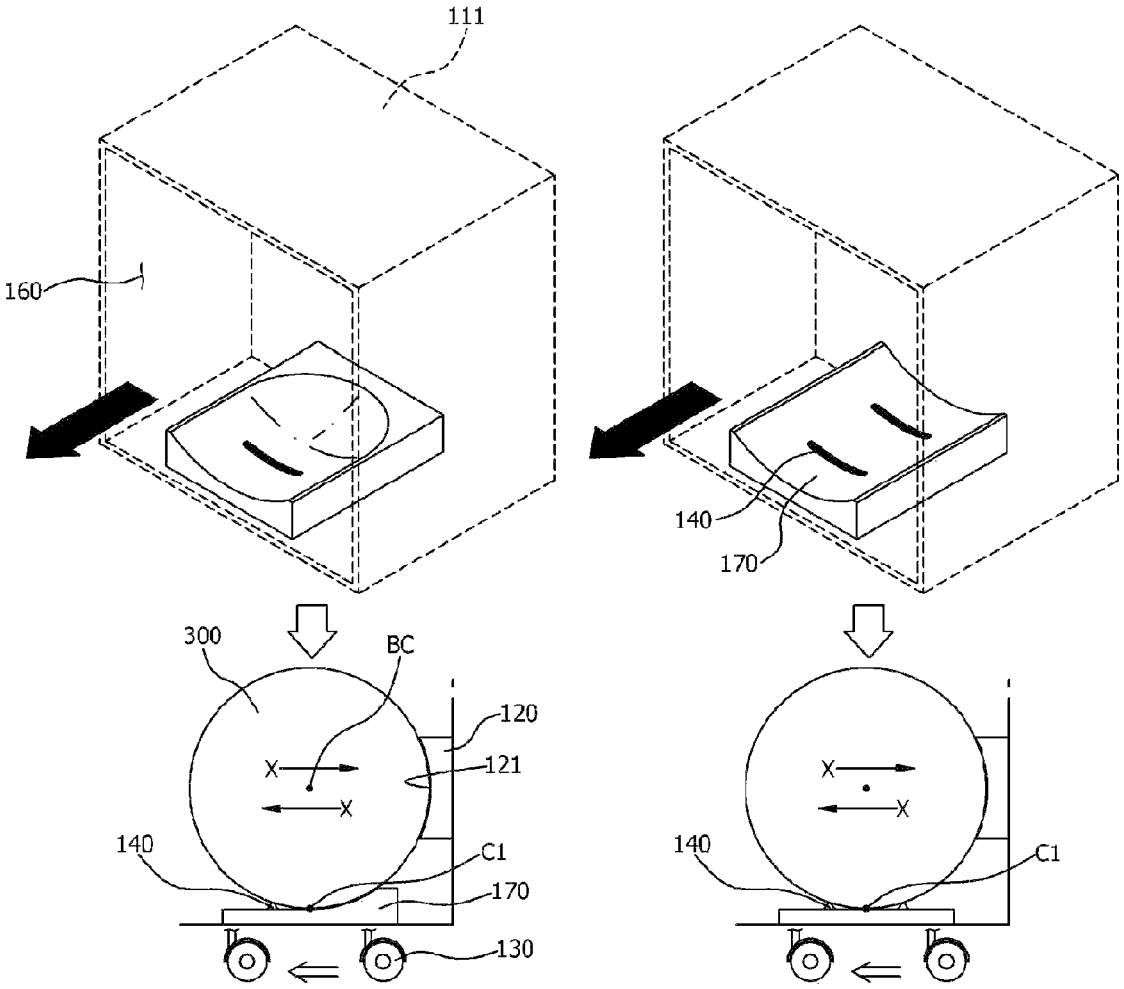
FIGS. 19 to 23 are use state views of ball cups configured to support bowling balls according to embodiments of the present invention, respectively.
Figure 20:
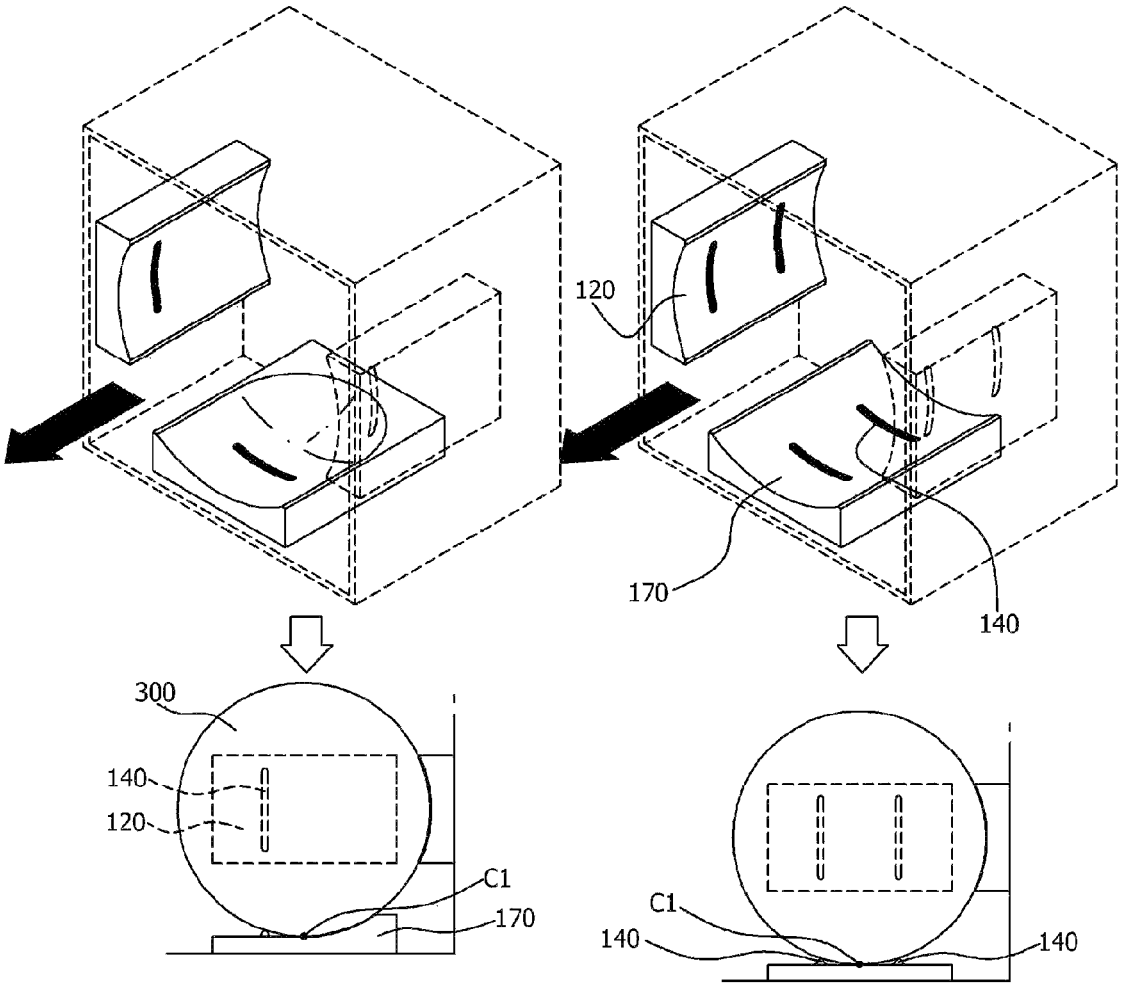
Figure 25:
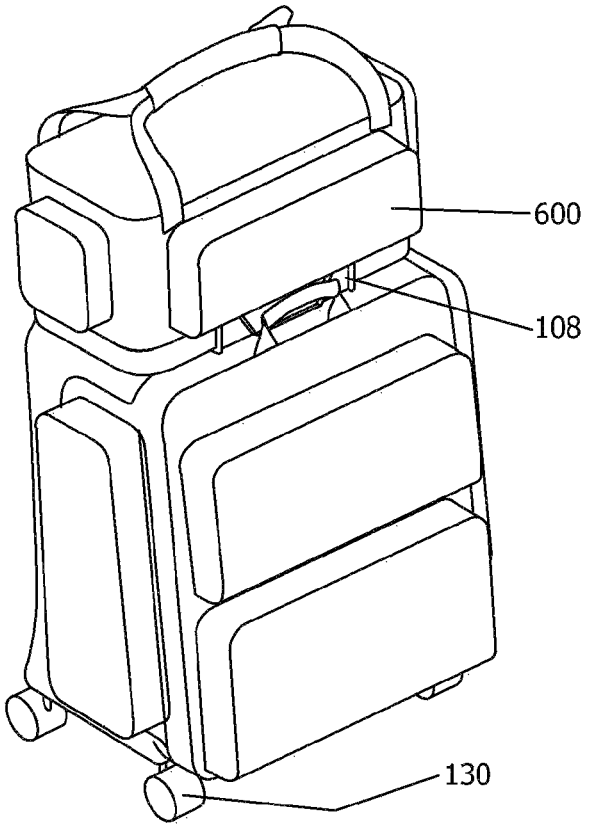

As shown in FIGS. 19 and 25, the ball cup or the support surface 120 having a space defined therein may be integrally formed with the frame 100 in a protruding state such that one or more bowling balls are supported in a stacked state in a vertical direction when the frame is molded.

The support surface 120 has a concave portion 121 formed so as to correspond to the shape of the bowling ball, and the concave portion is also formed such that the bowling ball can be introduced through the opening.

Figure 6:
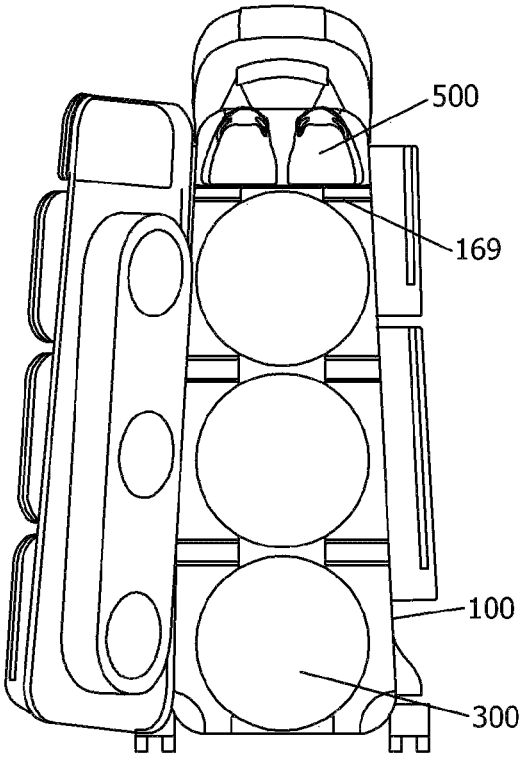
FIGS. 6 and 7 are exterior views showing bowling bags configured such that bowling shoes are received above and under three bowling balls according to other embodiments of the present invention, respectively.
Figure 12:
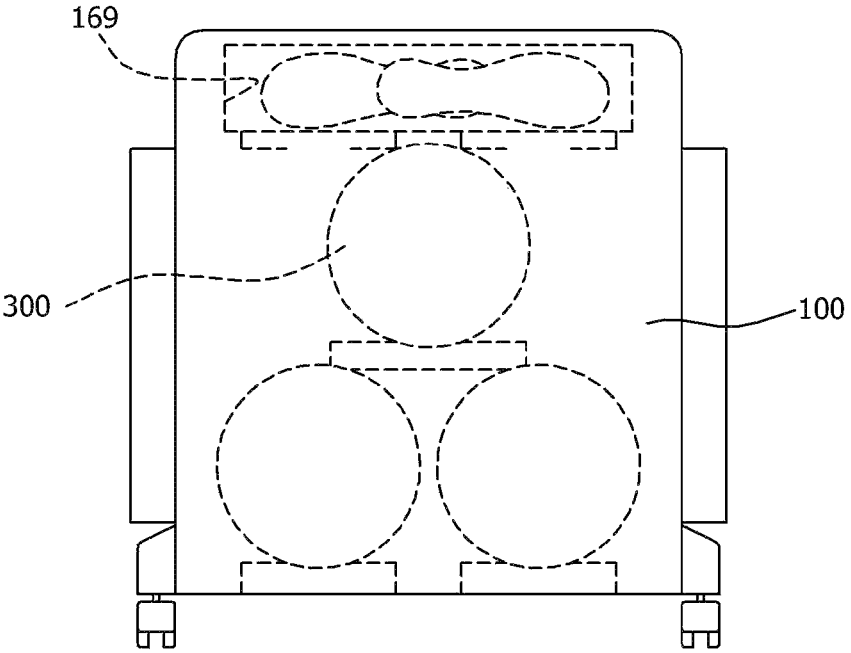
FIGS. 12 and 13 are use state views of bowling bags configured such that three and four bowling balls are received while bowling shoes are received at the same time according to other embodiments of the present invention, respectively.
Figure 13:
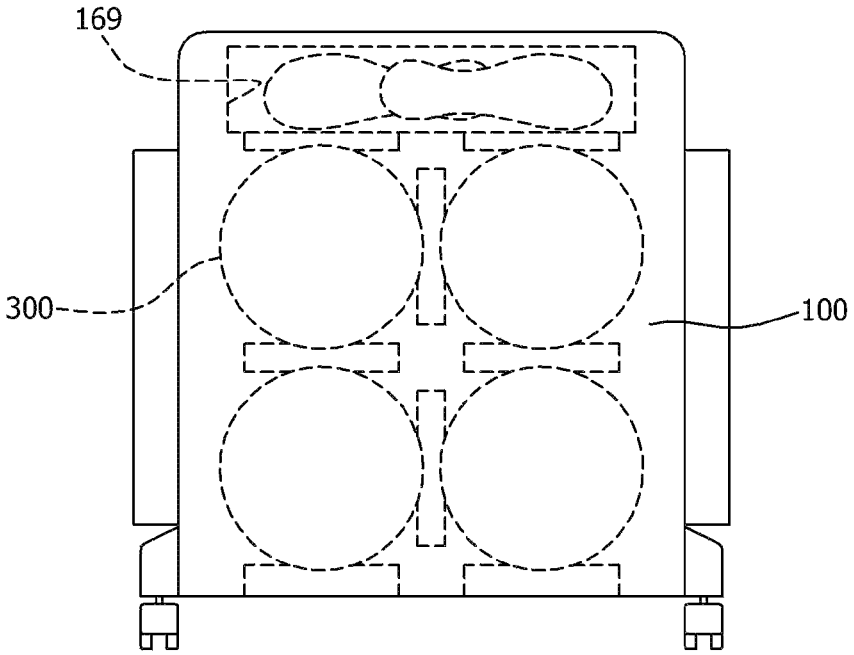

At this time, the ball cup is manufactured so as to have various shapes. One ball cup configured to support two bowling balls in an upward-downward direction inside the frame as shown in FIG. 9, three ball cups configured to support three bowling balls, i.e. one ball cup disposed above and two ball cups disposed at opposite sides below as shown in FIG. 12, or two ball cups configured to support three bowling balls in the upward-downward direction as shown in FIGS. 6 and 7 are integrally formed with the frame when the frame is molded.

In addition, a plurality of ball cups and a plurality of support surfaces are installed inside the frame so as to be located at proper positions depending on the loading shape of the bowling balls.

Figure 29:
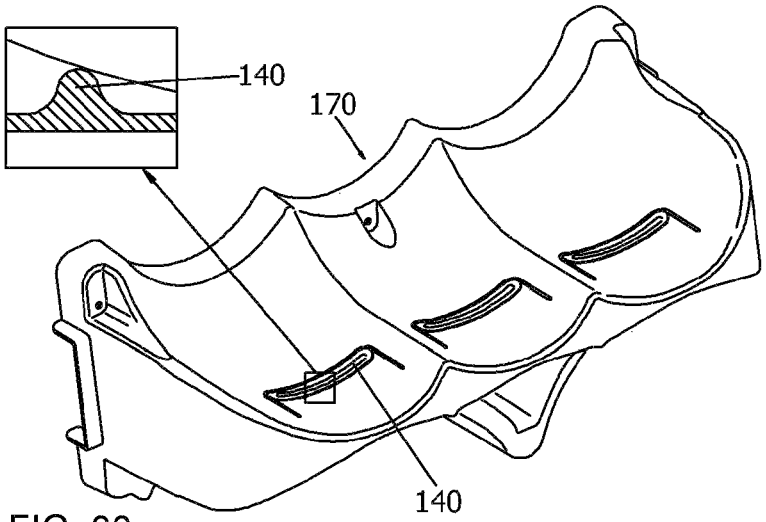
FIGS. 29 to 31 are stopper installation state views of ball cups according to embodiments of the present invention, respectively.

As shown in FIG. 29, the frame 100 may be installed so as to separate a space or to disperse a load through a separation plate 110 extending inside when the ball cup 170 is installed.

That is, the frame 100 is provided with openings 160 facing opposite side surfaces thereof, and a separation plate 110 configured to partition the opposite side openings 160 is integrally provided at a central part thereof in a vertical direction.

At this time, the separation plate 110 may be integrally provided with a support surface configured to support one side of the bowling ball.

In addition, a plurality of bowling balls is loaded in the frame in a stacked state in a vertical direction, and a space configured to receive shoes may be formed by a connection plate 169 integrally formed at the upper part or the lower part thereof.

At this time, the frame 100 may be installed such that drooping of the connection plate 169 is prevented through a partition plate (not shown) inside.

A reception chamber 190 having a door 191 is further connected to the frame 100 such that the upper surface thereof is opened and closed outside the frame at one side, whereby shoes or supplies are stored and withdrawn outside the frame.

A separate auxiliary bag 600 configured to receive a bowling ball 300 may be located on the frame 100.

At this time, the auxiliary bag 600 is installed such that left-right movement thereof is prevented through a support protrusion 108 protruding from a position provided above the frame 100 so as to be spaced apart therefrom.

Figure 14:
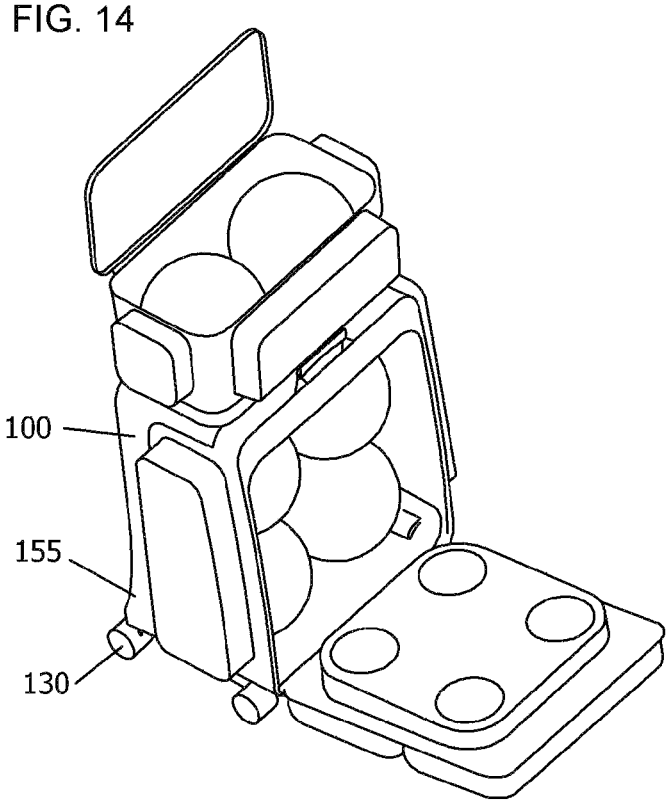
FIG. 14 is a use state view of a frame configured such that four bowling balls are loaded and an auxiliary bag configured such that two bowling balls are loaded according to the present invention.

As shown in FIG. 14, the auxiliary bag 600 may be configured to receive two bowling balls, and may be loaded on the quadrangular frame configured to receive four bowling balls.

Figure 3:
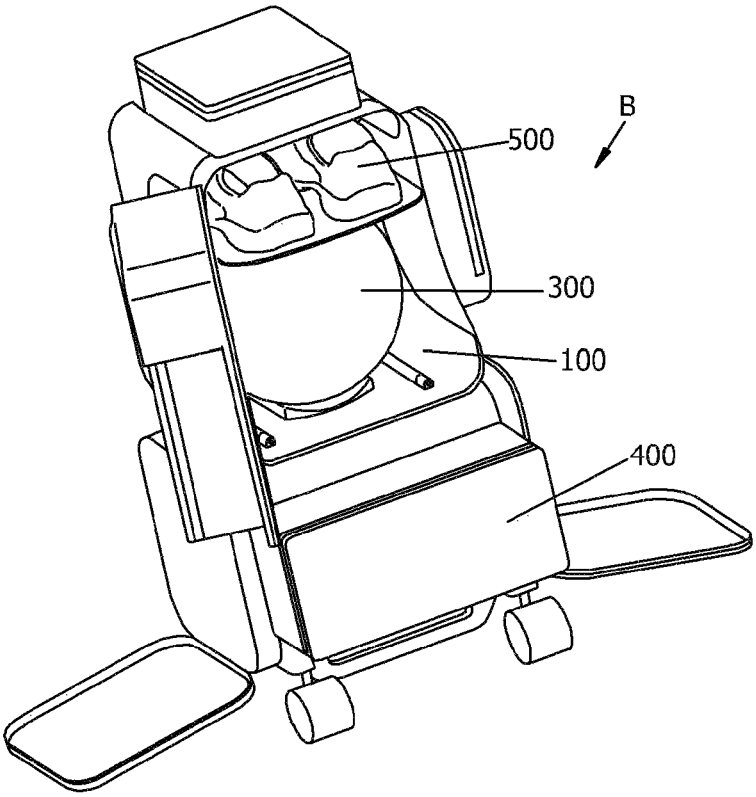
FIG. 3 is an exterior view showing a bowling bag according to the present invention.

When describing the shape of the frame in detail, the ball cup 170 and the support surface 120 are integrally formed at the frame so as to support one bowling ball in different directions as shown in FIG. 3, or the ball cup and a plurality of support surfaces 120 corresponding to the ball cup may be formed in the vertical direction so as to support two or more bowling balls in the vertical direction as shown in FIGS. 4 to 7.

Figure 4:
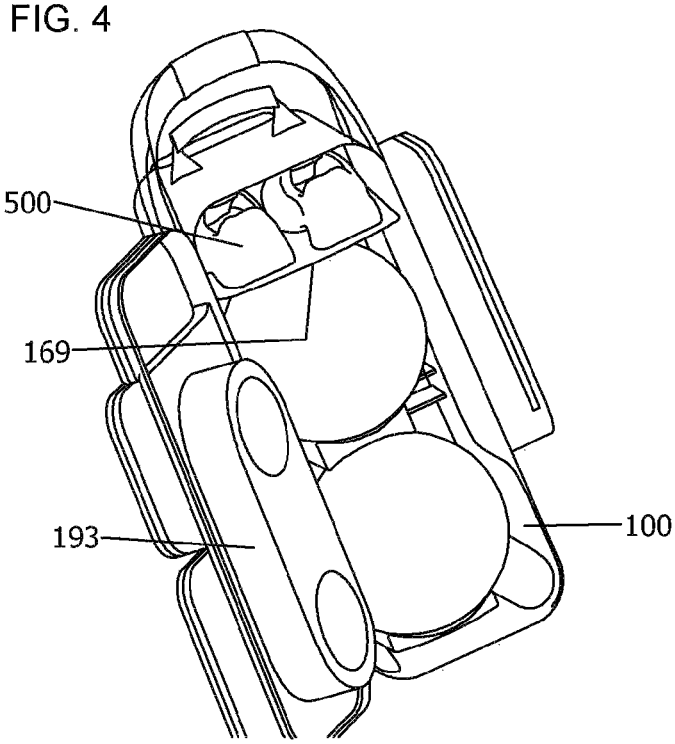
FIGS. 4 and 5 are exterior views showing bowling bags configured such that bowling shoes are received above and under two bowling balls according to other embodiments of the present invention, respectively.
Figure 5:
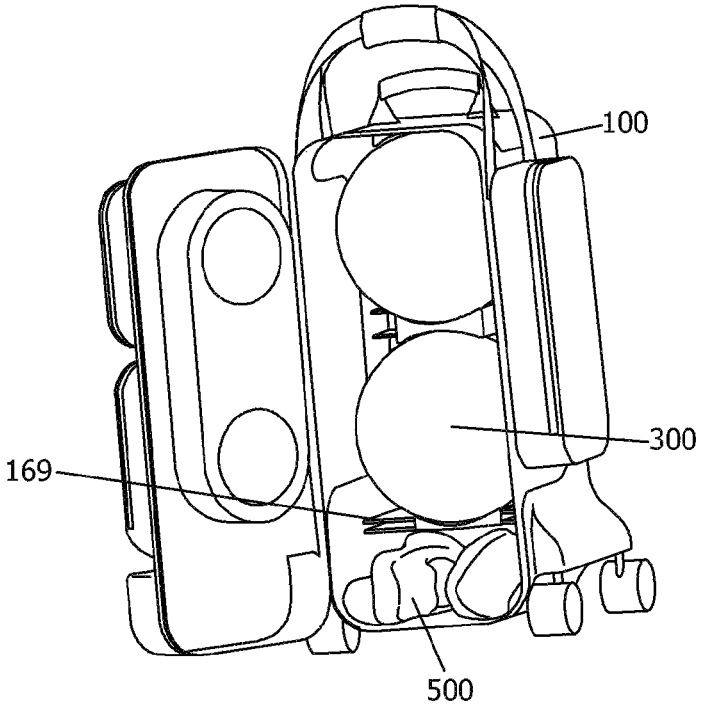

In addition, the frame 100 may be configured to receive two bowling balls in the vertical direction and to form a space configured to receive shoes by a connection plate 169 integrally formed at the upper part or the lower part thereof as shown in FIGS. 4 and 5, or may be configured to receive three bowling balls in the vertical direction and to form a space configured to receive shoes by a connection plate 169 integrally formed at the upper part or the lower part thereof as shown in FIGS. 6 and 7.

In addition, the frame 100 may be configured to receive three bowling balls in the vertical direction and to be further provided with a reception chamber 190 having a door 191, through which one side thereof is exposed to the outside, integrally connected to the upper part thereof as shown in FIG. 10.

Furthermore, the frame 100 may be configured to receive two bowling balls in a horizontal direction and to form a space configured to receive shoes at the upper part thereof, or may be configured to receive three or four bowling balls in a triangular shape or a quadrangular shape and to receive shoes at the upper part thereof as shown in FIGS. 12 and 14.

Figure 15:
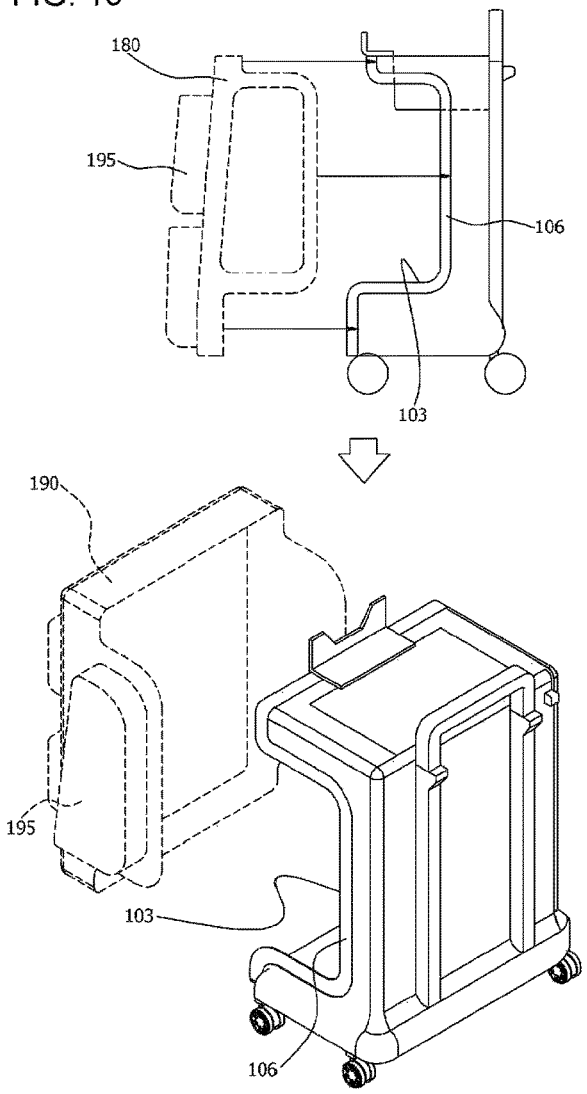
FIG. 15 is a sewed state view of a frame and a cover of a bowling ball according to the present invention.
Figure 16:
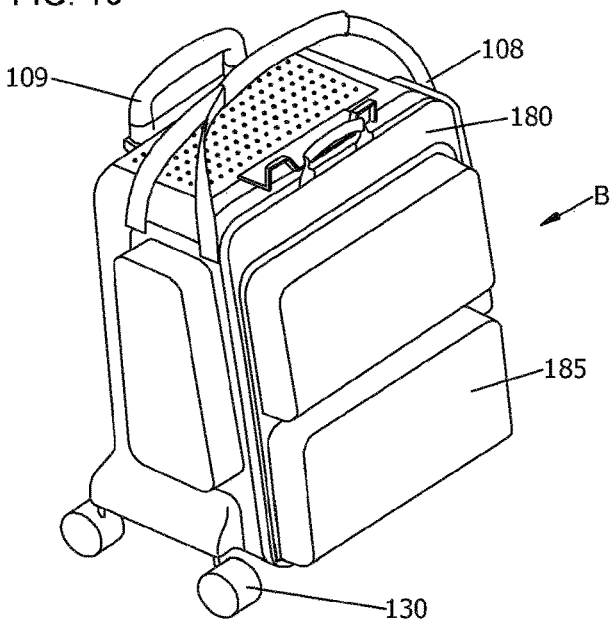
FIG. 16 is an exterior view showing a bowling bag according to the present invention.
Figure 17:
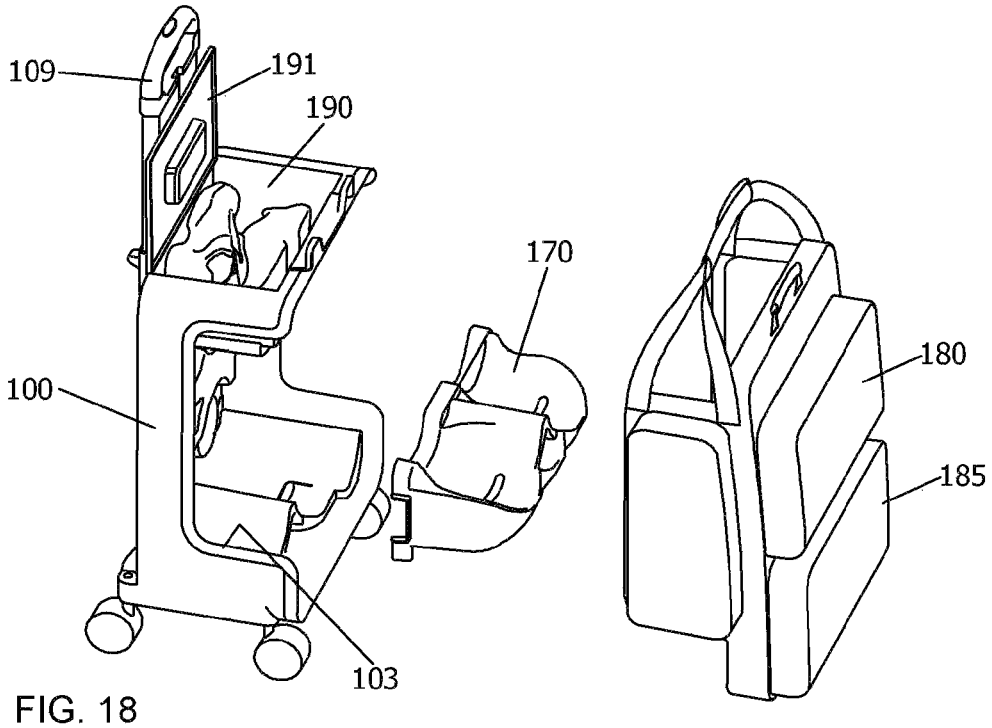
FIGS. 17 and 18 are assembly state views of a front reception type bowling bag and a side reception type bowling bag according to embodiments of the present invention, respectively.
Figure 18:
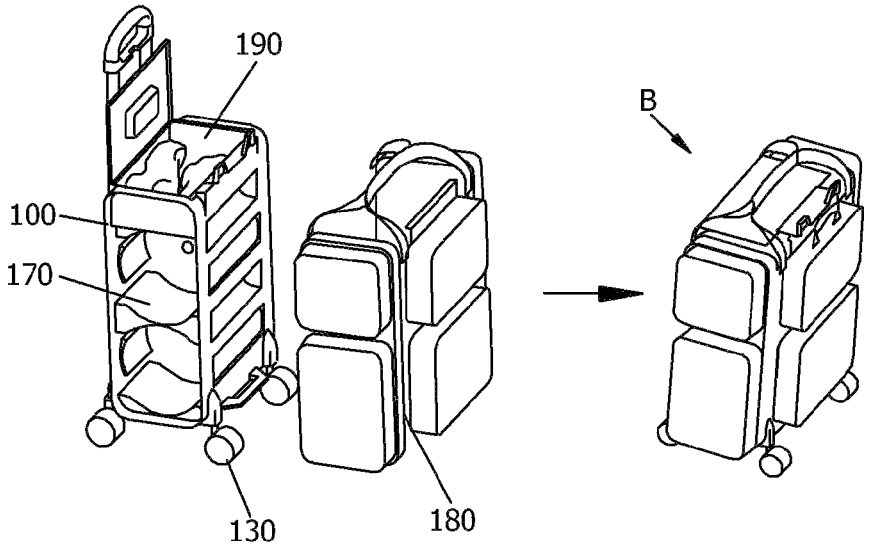

In addition, as shown in FIG. 15, a concave connection recess 103 inwardly depressed into a "["-shape is integrally formed at the inside of the frame 100 such that a cover 180 having a pocket 195 and made of a textile sheet is connected thereto by sewing, and a sewed portion 106 having a small thickness is provided along the edge thereof.

In addition, the pocket of the cover 180 is integrally provided at the portion corresponding to the concave connection recess 103 or one side thereof.

An auxiliary space 150 configured to receive shoes or supplies is installed at one of the upper part and the lower part of the inner surface of the frame 100 so as to be separated from the space through a partition plate (not shown) integrally provided at the frame.

At this time, a ball cup configured to support a bowling ball may be integrally formed at the upper part or the lower part of the auxiliary space 150.

In addition, the frame is installed such that, when an upper ball cup, which is one kind of ball cup, is coupled, the upper part extends in a lateral direction when the upper ball cup is coupled even though the upper part does not protrude, whereby the cover is supported by the protruding upper ball cup when the cover is connected to the frame by sewing such that the hexahedral shape thereof is maintained.

On the other hand, as shown in FIGS. 16 to 46, the bowling bag B according to the present invention is configured such that a stopper 140 is provided at one side of the ball cup 170 and opposite side surfaces or the upper surface of the frame 100 having the ball cup 170 so as to protrude from at least one of a position spaced apart from a contact point C1 at which the bowling ball contacts the ball cup toward the opening and a position spaced apart from the contact point C1 toward the inner surface of the space of the frame in order to prevent movement of the center BC of the bowling ball 300 when the frame is horizontally moved.

Figure 21:
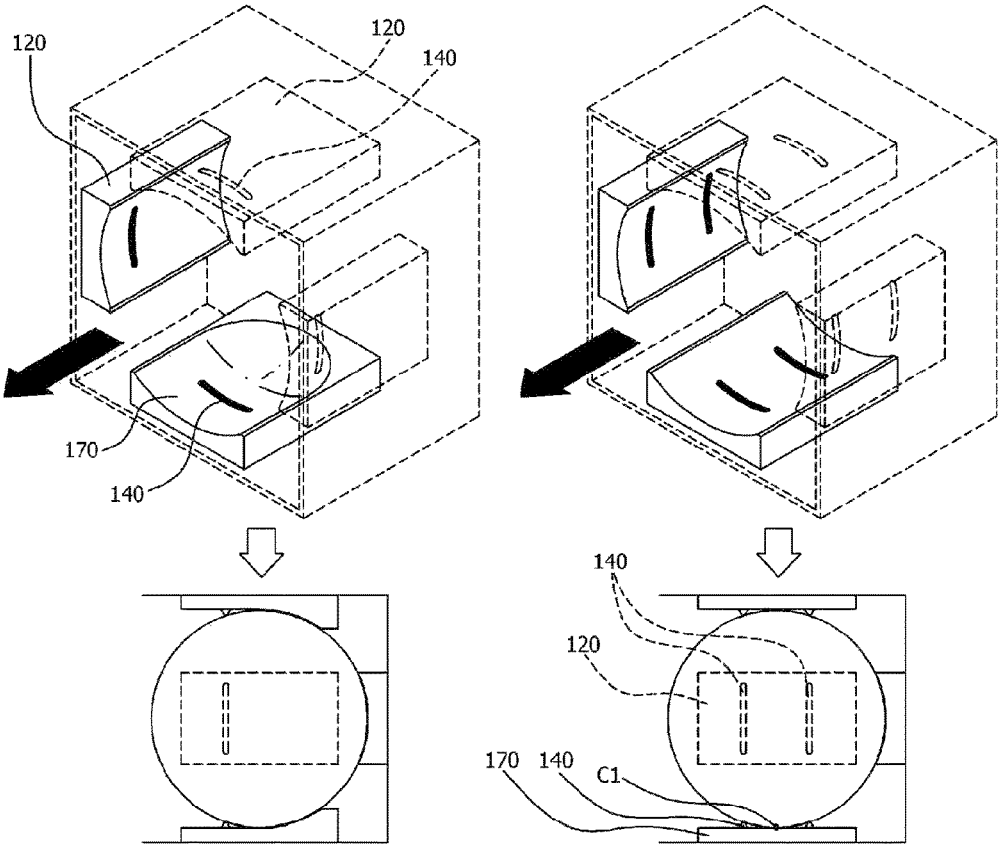
Figure 22:
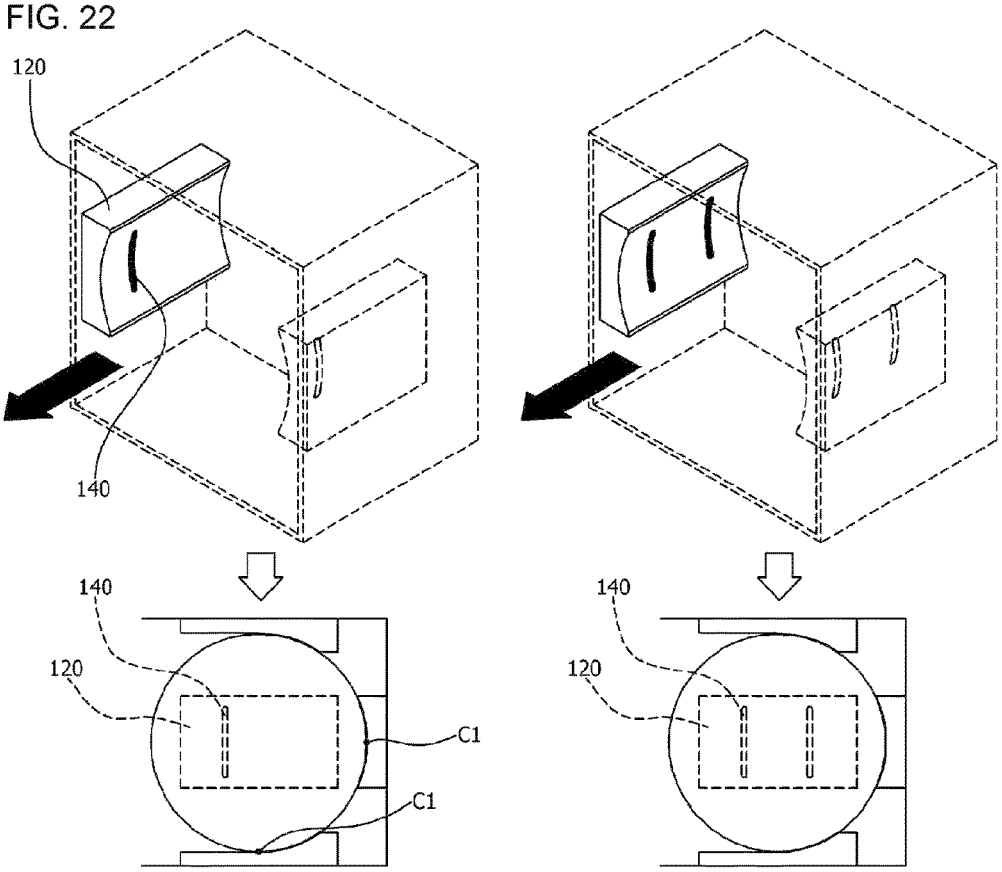
Figure 23:
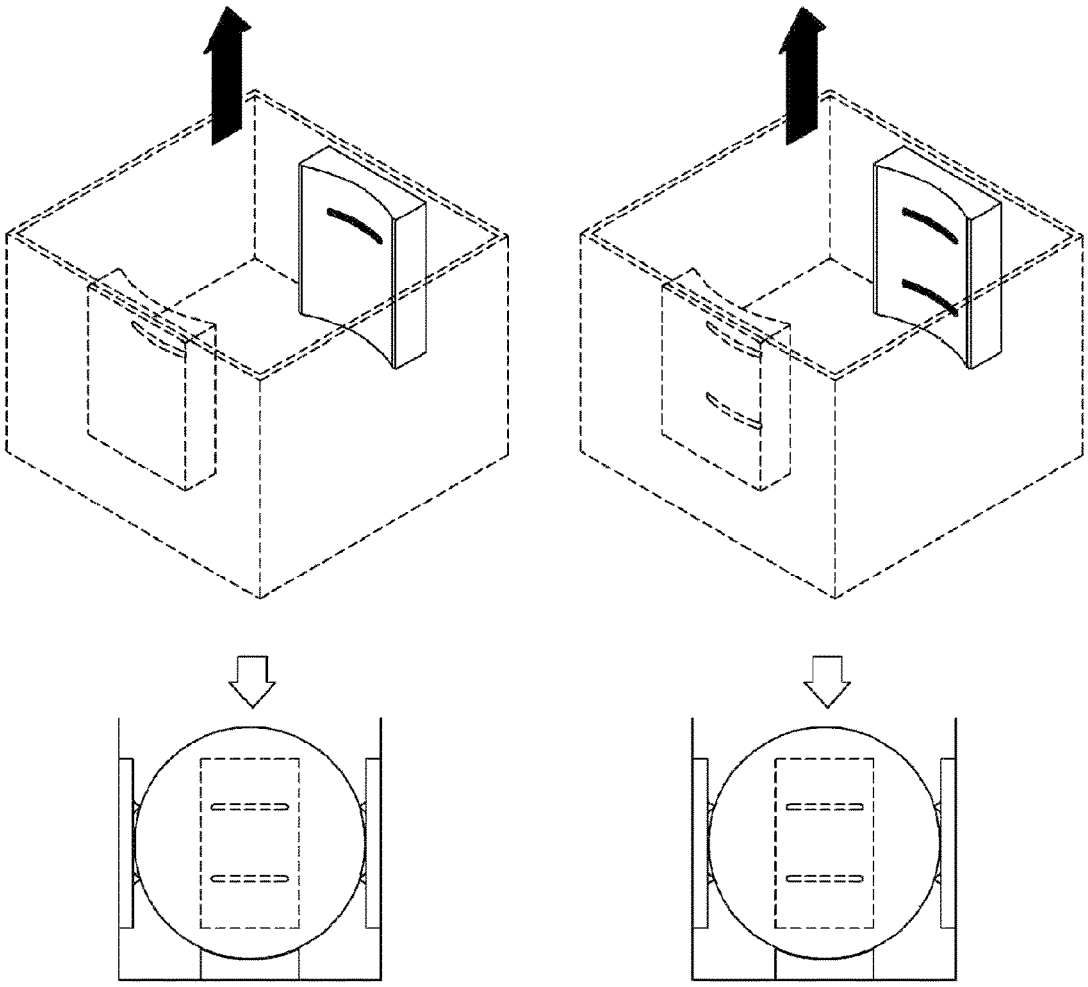
Figure 24:
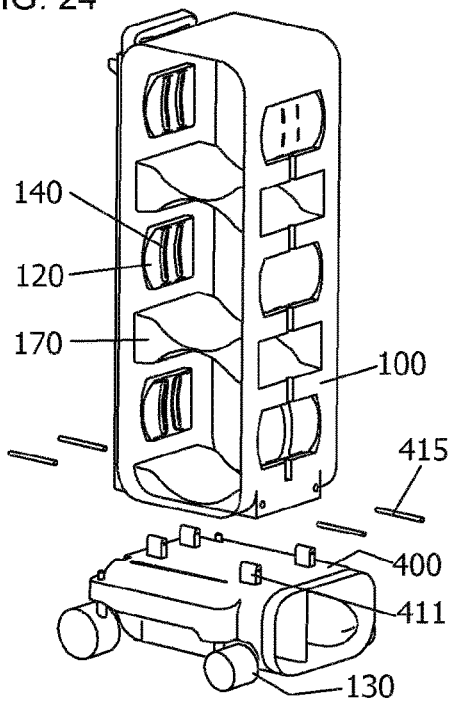
FIGS. 24 to 28 are an assembly state view of a frame, a stacked state view of an auxiliary bag, a connection state view of a roller, and an installation state view of a separation plate of the side reception type bowling bag according to embodiments of the present invention, respectively.

That is, as shown in FIGS. 21 and 22, the stopper 140 provided at the ball cup 170 is installed such that, when one point of the bowling ball is supported by the stopper, another point comes into tight contact with the concave portion, whereby movement of the bowling ball is prevented, or such that two points of the bowling ball are supported by two stoppers provided at the ball cup so as to be maintained in a planar state, whereby movement of the bowling ball is prevented.

The ball cup 170 is formed so as to support the lower surface or the upper surface of the bowling ball at the upper part or the lower part thereof, and is provided at one side thereof with at least one stopper 140 protruding from the plane.

At this time, at least one stopper 140 is provided at the upper surface or the lower surface of the ball cup 170 such that the upper part or the lower part of the ball cup supports the bowling ball located at the upper part or the lower part thereof.

A plurality of stoppers 140 may be formed so as to support the bowling ball at opposite sides spaced apart from the contact point C1 in order to prevent movement of the bowling ball located at the contact point C1 as the center.

In addition, the stopper 140 may be installed such that, when one side of the bowling ball is supported by the concave portion of the support surface, the other side of the bowling ball is supported by the stopper, whereby movement of the bowling ball is prevented.

Furthermore, the stopper 140 is molded so as to integrally protrude upwards when formed at the ball cup or the support surface.

In addition, a plurality of stoppers 140 is formed so as to support the bowling ball at opposite sides of the contact point C1 in order to prevent movement of the bowling ball located at the contact point as the center.

Figure 31:
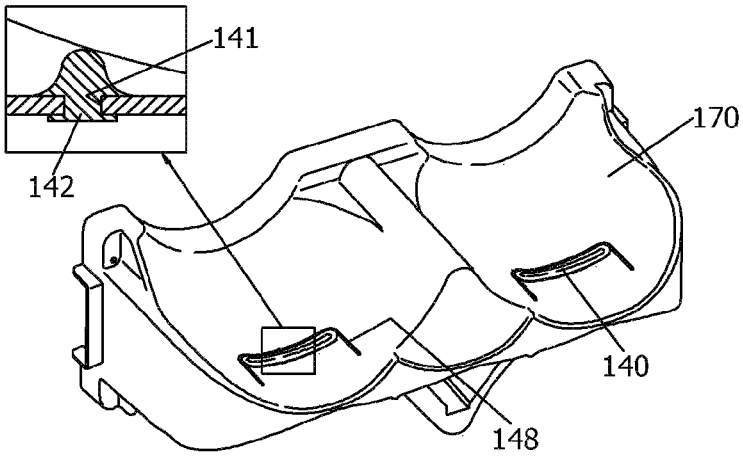
Figure 32:
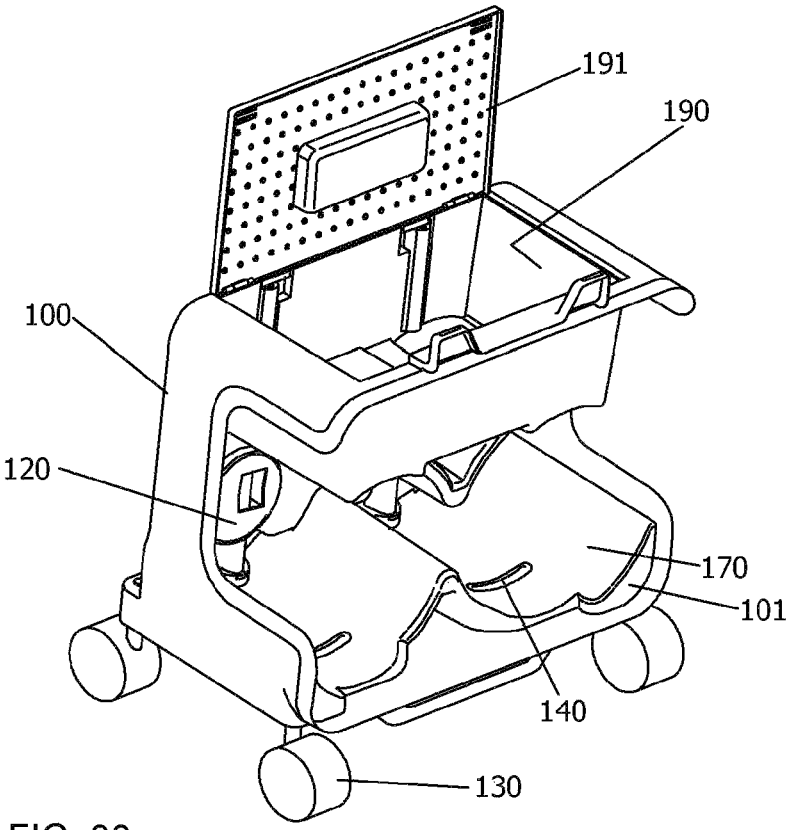
FIGS. 32 to 39 are use state views of bowling bags depending on the loading state of bowling balls received from the front according to embodiments of the present invention, respectively.

At this time, as shown in FIGS. 30 to 32, the stopper 140 may be configured such that a mounting recess 141 is formed in the ball cup or the support surface and the stopper is made of an elastic member provided with a mounting protrusion 142 while having a predetermined length so as to be coupled to the mounting recess, or may be configured such that the stopper is integrally bonded to the upper side of the ball cup or the support surface.

In addition, an incision portion 148 may be formed around the stopper in the horizontal direction or the vertical direction such that the stopper has predetermined elasticity at the position of the ball cup or the support surface at which the stopper is formed.

Furthermore, when installed at the middle, the upper part, and the lower part of the frame, the ball cup 170 may be divided into a lower ball cup 170A, on the upper surface of which the bowling ball is located, a middle ball cup 170B, on the upper surface and the lower surface of which the bowling balls are located, and an upper ball cup 170C, on the lower surface of which the bowling ball is located, depending on the installation position thereof.

Also, in the case in which the frame 100 is provided with one opening that faces forwards, the frame may be deformed to load two bowling balls in the horizontal direction, to load two bowling balls in the vertical direction, to load three bowling balls in the vertical direction, to load four bowling balls in the vertical direction, to load five bowling balls in the vertical direction, or to load six bowling balls in the vertical direction.

In the case in which the frame is provided with two openings that face opposite sides thereof, the frame may be deformed to load two bowling balls in the vertical direction, to load two bowling balls at the opposite sides thereof in the horizontal direction, to load four bowling balls in the vertical direction, or to load six bowling balls in the vertical direction.

The roller 130 may be provided with a brake, as in a carrier for heavy objects, so as to be stopped at a predetermined position.

Furthermore, the roller 130 may be installed at one side of the frame so as to extend therethrough in the state in which one end thereof is exposed, and may be integrally coupled to the frame through a fixing nut at the upper end thereof.

MODE FOR INVENTION

The operation of the present invention constructed as described above will be described.

As shown in FIGS. 3 to 46, in a bowling bag according to the present invention, four or more rollers 130 are installed at the lower part of a frame 100 configured to receive at least one bowling ball 300 therein such that the frame is horizontally moved on the ground, whereby the frame, in which a plurality of bowling balls, which are heavy objects, is easily moved on the ground in the horizontal direction, and therefore load of the frame due to movement thereof is minimized.

At this time, the frame 100 is configured such that an opening is formed in at least one of the front surface and the opposite side surfaces of a hexahedron that is made of a plastic material and has a space defined therein and such that a cover 180, which is made of a textile sheet, is connected to the opening by sewing, whereby it is possible to receive bowling balls from the front or from the opposite sides.

Furthermore, the cover 180 is provided with an elastic support block 193 having a concave recess 191 depressed to one side. When the cover 180 is coupled to the frame 100, therefore, the elastic support block supports one side surface of a bowling ball 300 supported by the lower part of a ball cup 170 in tight contact therewith, whereby movement of the bowling ball is prevented when the frame 100 is horizontally moved.

At this time, one or more ball cups 170 and support surfaces 120 are integrally provided at the inside of the frame 100 so as to correspond to six points, i.e. a rear point, a left point, a right point, an upper point, and a lower point, along the upper surface, the lower surface, and the outer circumference of the bowling ball 300, whereby the bowling ball is in tight contact with the inside of the frame, and therefore it is possible to securely support the bowling ball.

In addition, the ball cups and the support surfaces are disposed such that a plurality of bowling balls loaded in the vertical direction is located on a concentric axis during movement of the frame, whereby it is possible to prevent overturn of the frame due to movement of the center of gravity during movement of the frame.

That is, in the present invention, when bowling balls are received in the frame 100, as shown in FIGS. 7 and 8, the bowling balls located on the ball cups 170 in tight contact therewith due to weight of the bowling balls come into tight contact with the elastic support block 193 provided at the cover 180, whereby the bowling balls come into tight contact with one or more support surfaces 120 provided at the inner surface of the frame 100, and therefore movement of the bowling balls is prevented.

At this time, the frame 100 has a compact structure formed so as to have a width or height corresponding to the diameter of each bowling ball such that the inside of the frame that is horizontally moved by the rollers 130 connected to the bottom surface thereof comes into tight contact with the outside of the bowling balls, whereby movement of the bowling balls received in the frame is prevented.

In addition, as shown in FIG. 9, the roller 130 is freely rotatably connected to a support bracket 155 having a central shaft connected to the outer surface of the frame in a protruding state, i.e. integrally protruding by a predetermined distance t from opposite sides in at least one of the width direction and the depth direction of the frame, whereby upward movement of the center of gravity is prevented while a compact structure is provided.

In addition, the frame 100 is easily movable by a plurality of the rollers in the horizontal direction, whereby the frame is freely movable even in a narrow reception space 900, and therefore reception and withdrawal of the frame are easily performed.

Meanwhile, when an auxiliary bag 600 configured to receive a bowling ball 300 or bowling shoes 500 therein is loaded at the upper side of the frame 100 in a stacked state, it is possible to simultaneously carry the bowling balls in the frame and the bowling ball in the auxiliary bag.

In addition, even though an auxiliary frame 400 having rollers integrally connected thereto is further connected to the frame 100, it is possible to achieve the same purpose as the frame manufactured so as to have an integrated configuration.

At this time, the auxiliary frame and the frame are rapidly connected to each other through a coupling structure between a fixing protrusion 161 and a fixing recess and a fixing pin 167 configured to be inserted into the fixing protrusion and the fixing recess.

Furthermore, the ball cup is manufactured so as to have various shapes. One ball cup configured to support two bowling balls in the upward-downward direction inside the frame, three ball cups configured to support three bowling balls, i.e. one ball cup disposed above and two ball cups disposed at opposite sides below, or two ball cups configured to support three bowling balls in the upward-downward direction are integrally formed with the frame when the frame is molded.

In addition, the ball cup 170 is integrally formed with the frame by a mold introduced through the side of the frame when the frame is molded.

Figure 34:
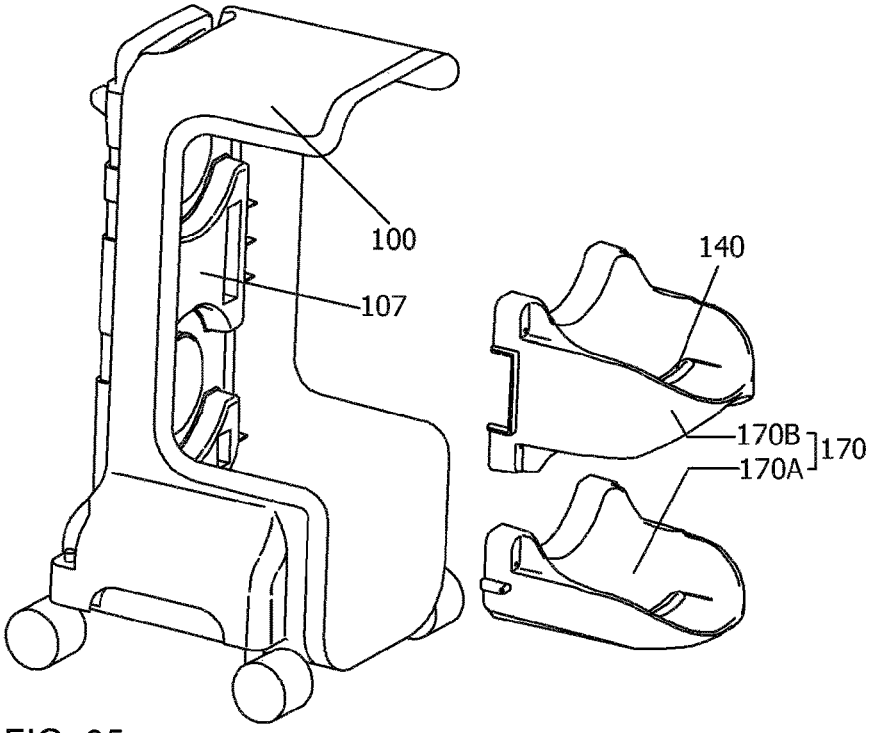

Furthermore, as shown in FIGS. 34 and 35, the ball cup 170 is separately manufactured, and is fitted onto a support portion 107 integrally protruding from the frame 100 and is coupled to the support portion via a screw (not shown) at the time of assembly coupling.

At this time, the support portion integrally protrudes so as to have a shape corresponding to the rear surface of the ball cup injection-molded when the frame is molded such that the support portion and the ball cup are assembled with each other by fitting.

The frame 100 is provided at the inside thereof with a partition plate (not shown) located in a direction perpendicular to a connection plate in order to support a load.

In addition, a plurality of bowling balls is loaded in the frame in a stacked state in the vertical direction, and a space configured to receive shoes may be formed by a connection plate 169 integrally formed at the upper part or the lower part thereof.

Furthermore, a reception chamber 190 having a door configured to be opened by one touch from the outside is connected to the upper part of the frame, whereby bowling shoes may be received and withdrawn without opening of the frame.

The frame is further provided at the upper side thereof with a support protrusion 108. When the auxiliary bag 600 configured to receive the bowling ball is loaded, therefore, the support protrusion comes into tight contact with one side of the auxiliary bag 600, and therefore the auxiliary bag may be horizontally moved simultaneously with the frame without movement thereof in a loaded state.

In addition, as shown in FIGS. 15 and 34, the frame 100 according to the present invention is provided at the side surface thereof with a "["-shaped concave connection recess 103 depressed inwards, and a sewed portion 106 having a small thickness is provided along the edge thereof, whereby sewing of the cover 180 is easily performed.

At this time, a pocket 185 is integrally provided at the portion of the cover 180 corresponding to the concave connection recess 103, whereby the weight of the frame may be reduced while space utilization is achieved. Bowling supplies may be stored outside the cover 180 through the pocket 185, which is installed to be opened and closed by a zipper.

In addition, the frame 100 is configured such that the cover 180, which is made of a textile sheet and is installed so as to open and close a portion of the opening, is connected to the opening 160 by sewing, whereby the bowling balls received in the space are easily protected from external impact while not being exposed to the outside.

The frame 100 is further provided at the rear surface thereof with a handle 109 configured to be telescoped like an umbrella, whereby horizontal movement of the frame is easily performed. The cover made of the textile sheet may also be provided with a separate auxiliary handle (not shown) made of a textile sheet or a plastic material.

In the bowling bag according to the present invention, on the other hand, stoppers 140 are provided at one side of the ball cup 170 and at the support surfaces of the opposite side surfaces of the frame 100 having the ball cup 170, whereby movement of the bowling ball during movement of the frame is prevented and falling of the bowling ball is prevented when the cover is opened after the frame is stopped.

In addition, movement of the bowling ball is prevented through the stopper 140 provided at the ball cup 170, whereby movement of the bowling ball is prevented when the frame is horizontally moved.

At this time, as shown in FIGS. 20 to 24, the stopper 140 is provided on at least one of a position spaced apart from a contact point C1 at which the bowling ball contacts the ball cup toward the opening and a position spaced apart from the contact point C1 toward the inner surface of the space of the frame in order to prevent movement of the center BC of the bowling ball 300 when the frame is horizontally moved, whereby movement of the bowling ball 300 is prevented.

In addition, the ball cup 170 is formed so as to support the lower surface or the upper surface of the bowling ball at the upper part or the lower part thereof, and is provided at one side thereof with one or more stoppers 140 protruding from the plane. When the ball cups are located at the upper part and the lower part of the bowling ball, the stoppers support the upper part and the lower part of the bowling ball, whereby movement of the center of the bowling ball is prevented.

At this time, the ball cups 170 are formed in left-right symmetry and in up-down symmetry. Consequently, the ball cups have a simple structure, mass production of the ball cups through injection molding is possible, and the ball cups are coupled to the frame via screws.

In addition, at least one stopper 140 is provided at the upper part or the lower part of the ball cup 170, which is integrally formed or separately manufactured, as described above, to support the bowling ball located at the upper part or the lower part thereof.

Furthermore, as shown in FIGS. 20 to 24, a support surface 120 having a concave portion 121 formed therein so as to correspond to the shape of the bowing ball is integrally formed on at least one of the rear surface, the opposite side surfaces, the upper surface, and the lower surface of the frame 100 at the inside thereof and the upper surface and the lower surface of the ball cup so as to protrude when the frame is molded, whereby the other surface of the bowling ball supported by the stopper of the ball cup is supported.

At this time, movement of the bowling ball is prevented due to interaction between contact surfaces formed at the stopper and the support surface.

A plurality of stoppers 140 may be formed so as to support the bowling ball at opposite sides of the contact point C1 in order to prevent movement of the bowling ball located at the contact point C1 as the center, whereby, when the center of the bowling ball in the vertical direction is located at the contact point, movement of the bowling ball is prevented by the stoppers protruding from opposite sides thereof.

Furthermore, as shown in FIGS. 30 to 32, the stopper 140 may be integrally formed so as to protrude upwards when formed at the ball cup or the support surface, may be configured such that a mounting recess 141 is formed in the ball cup or the support surface and the stopper is made of an elastic member provided with a mounting protrusion 142 and having a predetermined length so as to be coupled to the mounting recess, or may be configured such that the stopper is integrally bonded to the upper side of the ball cup or the support surface.

In addition, an incision portion 148 may be formed around the stopper in the horizontal direction or the vertical direction such that the stopper has predetermined elasticity at the position of the ball cup or the support surface at which the stopper is formed, whereby the bowling ball may move over the stopper so as to be easily positioned when the bowling ball is introduced.

Figure 46:
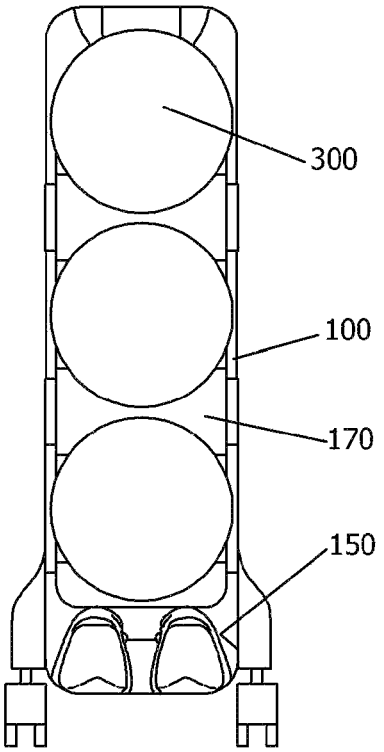

In addition, as shown in FIG. 46, an auxiliary space 150 configured to separately receive shoes or supplies is installed at one of the upper part and the lower part of the inner surface of the frame 100 so as to be separated from the space.

At this time, a ball cup configured to support the bowling ball may be integrally formed at the upper part or the lower part of the auxiliary space 150, whereby, when the bowling ball approaches one side thereof, the bowling ball 300 is easily supported.

In addition, the ball cup 170 may be manufactured so as to have various shapes depending on the position of the bowling ball, such as a lower ball cup 170A, on the upper surface of which the bowling ball is located, a middle ball cup 170B, on the upper surface and the lower surface of which the bowling balls are located, and an upper ball cup 170C, on the lower surface of which the bowling ball is located, depending on the installation position thereof when installed at the middle, the upper part, and the lower part of the frame, as shown in FIGS. 34 to 37.

In addition, the frame is applied together with ball cups having various shapes, such as the lower ball cup, the middle ball cup, and the upper ball cup. When the ball cup is supported at the upper part of the frame in a shape identical to the upper ball cup, the upper part of the frame is maintained in a shape protruding by the upper ball cup without needing to form a separate concave connection recess in the side surface of the frame, whereby the cover is supported by the protruding upper ball cup when the cover is connected to the frame by sewing such that the hexahedral shape thereof is maintained.

Figure 33:
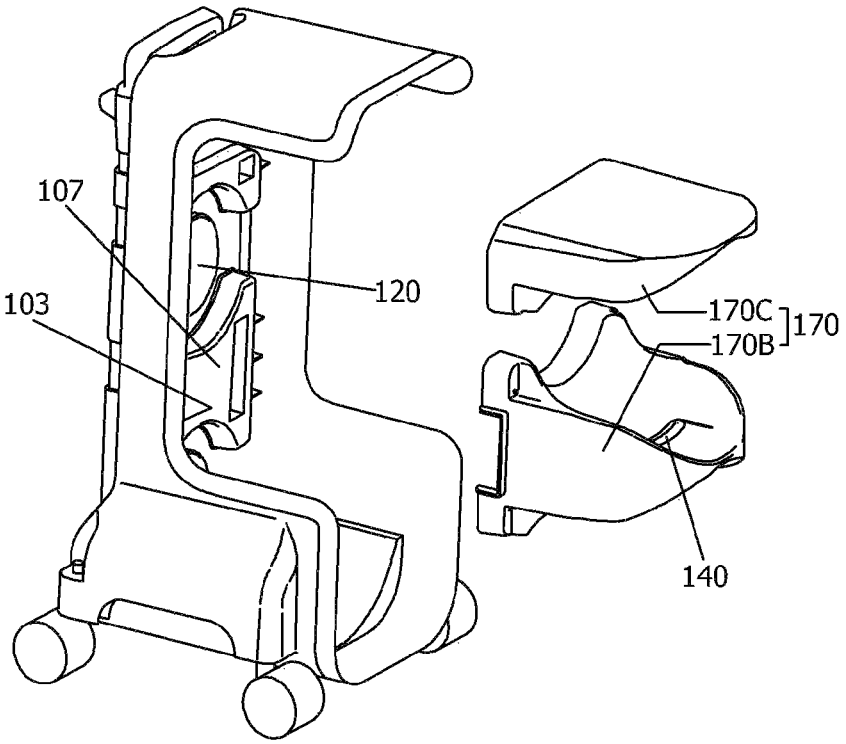

In addition, as shown in FIG. 33, a reception chamber 190 having a door 191 is further connected to the frame 100 such that the upper surface thereof is opened and closed outside the frame at one side, whereby shoes or supplies are easily stored and withdrawn outside the frame without needing to open the cover.

At this time, a ball cup is also integrally formed at the lower part of the reception chamber 190 to support the upper part of the bowling ball.

In addition, as shown in FIG. 25, an auxiliary frame 400, which is separately manufactured, may be integrally coupled to the lower part of the frame 100, and the auxiliary frame 400 is provided at the bottom surface thereof with three or more rollers 130 while the auxiliary frame receives shoes or supplies therein, whereby the frame and the auxiliary frame may be simultaneously horizontally moved.

The frame 100 is provided with openings 160 facing opposite side surfaces thereof, whereby it is possible to receive bowling balls at opposite sides thereof, and a separate pate 110 configured to partition the opposite side openings is integrally provided at a central part of the frame in the vertical direction, whereby the bowling balls received at the opposite sides thereof are separated from each other.

At this time, the separation plate 110 is integrally provided with a support surface, whereby it is possible to easily support the bowling ball.

Also, in the case in which the frame 100 is provided with one opening that faces forwards, the frame may be deformed to load two bowling balls in the horizontal direction, to load two bowling balls in the vertical direction, to load three bowling balls in the vertical direction, to load four bowling balls in the vertical direction, to load five bowling balls in the vertical direction, or to load six bowling balls in the vertical direction.

In the case in which the frame is provided with two openings that face opposite sides thereof, the frame may be deformed to load two bowling balls in the vertical direction, to load two bowling balls at opposite sides in the horizontal direction, to load four bowling balls in the vertical direction, or to load six bowling balls in the vertical direction.

Figure 26:
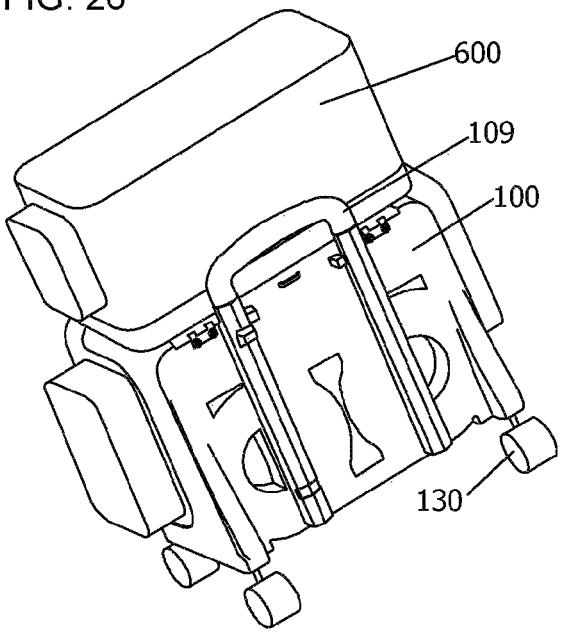
Figure 27:
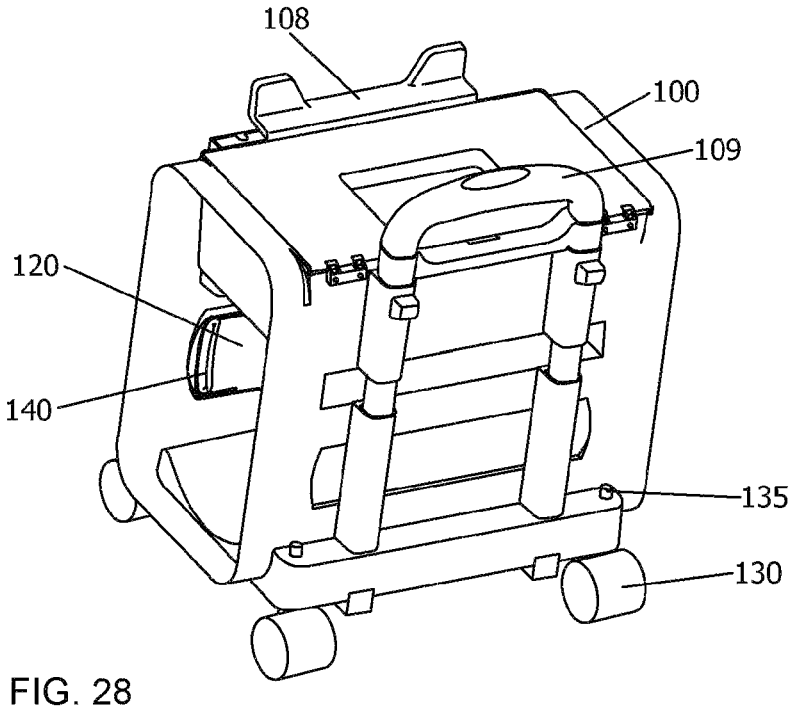
Figure 28:
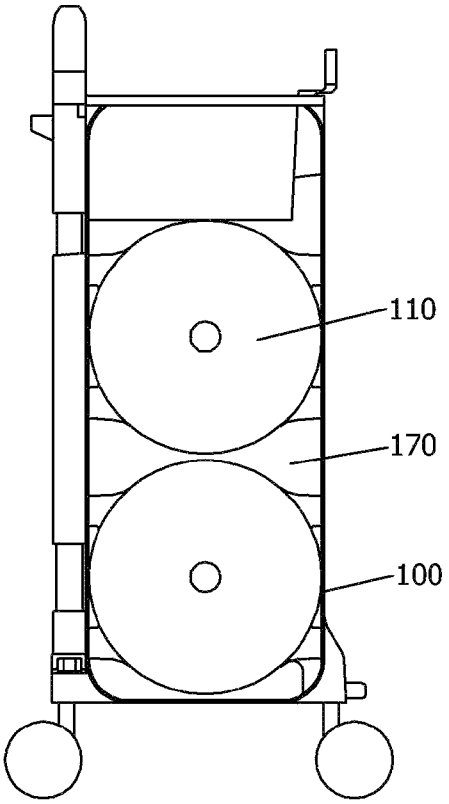

As shown in FIG. 26, the frame 100 is moved in the state in which a separate auxiliary bag 600 configured to receive the bowling ball 300 is located on the frame.

At this time, left-right movement of the auxiliary bag 600 is prevented through a support protrusion 108 at the upper part of the frame 100, whereby falling of the auxiliary bag is prevented when the frame is moved.

The present invention described above is not limited by the above embodiments and the accompanying drawings, and it will be obvious to a person having ordinary skill in the art to which the present invention pertains that various substitutions, modifications, and alterations are possible without departing from the technical idea of the present invention.

The present invention is applied to manufacture of a bowling bag configured such that, in order to prevent movement or falling of a bowling ball when a frame having a ball cup is horizontally moved or when a cover is opened, each of three or more points of the bowling ball including the lower surface of the bowling ball and the bottom surface of the bowling ball along the outer circumference thereof is adjacent to or supported by the ball cup, whereby the frame is easily moved in a horizontal direction without movement of a plurality of bowling balls in the state in which the bowling balls is supported inside the frame when the frame is horizontally moved.

The invention claimed is:

1. A horizontally movable bowling bag capable of preventing movement of a bowling ball, the horizontally movable bowling bag comprising:

a frame having a space defined therein so as to receive two or more bowling balls in a state of being loaded in a vertical direction or a horizontal direction, the frame being provided at a bottom surface thereof with three or more rollers such that the frame is horizontally moved on a ground, wherein the frame is configured as follows:

a. at least one ball cup is provided in the inner space of the frame so as to support a plurality of bowling balls loaded in the frame in at least one of the vertical direction and the horizontal direction;

b. the frame is a hexahedral structure made of a plastic material, has a space defined therein, and is provided in at least one surface thereof that faces forwards or opposite sides with an opening; and c. a cover made of a textile sheet and installed to open and close a portion of the opening is connected to the opening by sewing, a stopper is provided at one side of the ball cup and opposite side surfaces or the upper surface of the frame having the ball cup so as to protrude from at least one of a position spaced apart from a contact point at which the bowling ball contacts the ball cup toward the opening and a position spaced apart from the contact point toward the inner surface of the space of the frame in order to prevent movement of the bowling ball when the frame is horizontally moved, the stopper has any one of:

a configuration in which the stopper integrally protrudes from the ball cup or a support surface;

a configuration in which the stopper is provided with an elastic member provided with a mounting protrusion while having a predetermined length so as to be supported by a mounting recess provided at the ball cup or the support surface; and a configuration in which the stopper is integrally bonded to an upper side of the ball cup or the support surface so as to protrude upwards, and an incision portion is formed around the stopper so as to face in the horizontal direction or the vertical direction such that the stopper has predetermined elasticity at a position at which the stopper is formed.

2. The horizontally movable bowling bag according to claim 1, wherein the ball cup is separately manufactured so as to be assembled with a support portion integrally protruding from the frame by fitting and is then coupled to the frame via a screw, the ball cup coupled to the frame is formed so as to support an upper part or a lower part of the bowling ball, and the ball cup is provided on one side thereof with a stopper.

3. The horizontally movable bowling bag according to claim 1, wherein the frame is integrally provided at a side surface thereof with a concave connection recess inwardly depressed into a "[]"-shape such that the cover having a pocket is connected to the frame, and an auxiliary space configured to receive shoes or supplies is installed at one of an upper part and a lower part of the inner surface of the frame so as to be separated from the space.

4. The horizontally movable bowling bag according to claim 1, wherein a reception chamber having a door configured to be opened to an outside of the frame is further connected to an upper part of the frame, whereby shoes or supplies are stored and withdrawn outside the frame.

* * * * *